US006176168B1

(12) United States Patent
Keil et al.

(10) Patent No.: US 6,176,168 B1
(45) Date of Patent: Jan. 23, 2001

(54) TRANSMITTER COIL, IMPROVED FUZE SETTER CIRCUITRY FOR ADAPTIVELY TUNING THE FUZE SETTER CIRCUIT FOR RESONANCE AND CURRENT DIFFERENCE CIRCUITRY FOR INTERPRETING A FUZE TALKBACK MESSAGE

(75) Inventors: Robert E. Keil, Plymouth; Randy E. Humbert, Becker, both of MN (US)

(73) Assignee: Alliant Techsystems Inc., Hopkins, MN (US)

( * ) Notice: Under 35 U.S.C. 154(b), the term of this patent shall be extended for 0 days.

(21) Appl. No.: 09/302,136

(22) Filed: Apr. 29, 1999

(51) Int. Cl.[7] ..... F42C 11/04
(52) U.S. Cl. ..... 89/6.5; 89/6; 102/215
(58) Field of Search ..... 89/6.5, 6; 102/215, 102/270

(56) References Cited

U.S. PATENT DOCUMENTS

| | | | | |
|---|---|---|---|---|
| 4,144,815 | * | 3/1979 | Cumming et al. | 102/214 |
| 4,649,796 | * | 3/1987 | Schmidt | 89/6.5 |
| 5,113,766 | * | 5/1992 | Grosch | 89/6.5 |
| 5,117,732 | | 6/1992 | Munzel et al. | 89/6.5 |
| 5,117,733 | * | 6/1992 | Fischer et al. | 89/6.5 |
| 5,343,795 | | 9/1994 | Ziemba et al. | 89/6.5 |
| 5,497,704 | * | 3/1996 | Kurschner et al. | 89/6.5 |

* cited by examiner

*Primary Examiner*—J. Woodrow Eldred
(74) *Attorney, Agent, or Firm*—Vidas, Arrett & Steinkraus, PA

(57) ABSTRACT

Improved transmitter coil, improved fuze setter circuitry for adaptively tuning the fuze setter circuit for resonance and current difference circuitry for interpreting a fuze talkback message. The transmitter coil utilizes an "L" shaped coil cross section, with the wrapped coil portion being at right angles to the return coil portion, in order to increase the coupling efficiency between the fuze setter coil and the fuze receiver coil, as compared to the prior art "C" coil. The inventive "L" shaped cross section also eliminates counter magnetic field due to the return coil portion being at right angles to the wrapped coil portion. The fuze setter includes circuitry for adaptively tuning the resonant LC circuit for resonance by adjusting the capacitance in the LC circuit to maximize current in the LC circuit. The fuze setter utilizes a switched capacitor network circuit to tune the LC circuit for resonance. The fuze circuitry modulates its impedance, which results in changes in the current in the resonant LC circuit of the fuze setter which are detected and interpreted by the fuze setter circuit.

15 Claims, 27 Drawing Sheets

TRANSMITTER COIL, IMPROVED FUZE SETTER CIRCUITRY FOR ADAPTIVELY TUNING THE FUZE SETTER CIRCUIT FOR RESONANCE AND CURRENT DIFFERENCE CIRCUITRY FOR INTERPRETING A FUZE TALKBACK MESSAGE

STATEMENT REGARDING FEDERALLY SPONSORED RESEARCH

The Government has rights in this invention pursuant to Government Contract No. DAAE30-95-C-0009, awarded by The Army's Research Development, and Engineering Center (ARDEC).

BACKGROUND OF THE INVENTION

The present invention relates to an improved transmitter coil of a fuze setter and improved fuze setter circuitry for adaptively tuning the circuit for resonance and current difference circuitry for interpreting a fuze talkback message.

Inductive fuze setters are well known in the art. U.S. Pat. No. 5,343,795, entitled "Settable Electronic Fuzing System For Cannon Ammunition", issued Sep. 6, 1994 to General Electric Co. is directed to one such system. The entire contents of U.S. Pat. No. 5,343,795 are hereby incorporated by reference. Inductive fuze setters are used to transmit detonation data to a projectile warhead, such as time-of-flight or turns-to-burst data, as is well known in the art. Rapid-fire canons can have a fire rate ranging from 10 rounds per minute to 10 rounds per second or greater, and therefore it is very important to be able to quickly transmit data to a projectile as it is moving from a magazine to the cannon. Moreover, it is extremely important to verify that the projectile has correctly received the transmitted data.

NATO has a standard STANAG 4369 and the AOP-22 which govern the communications between a fuze setter and a fuze. This specifies a 100 KHz carrier signal which is pulse width modulated (PWM) for the forward message, which transmits the detonation data to the projectile and pulse code modulated (PCM) for the reverse or talkback message, in which the faze confirms the transmitted data.

As is well known in the art, the magnetic interface between the fuze setter and the fuze must allow energy transfer to "charge" the fuze circuit as well as be sensitive enough to detect and interpret the talkback signal transmitted by the fuze circuit with the power available from the "charge" portion of the communication from the fuze setter.

The prior art detected and interpreted the talkback message by detecting the phase change that occurs between the fuze setter circuit voltage and current during talkback, as the fuze is modulating the fuze coil impedance. However, this method suffers from the problem of a loss of signal when the LC circuit of the fuze setter is at resonance due to a null in the phase response. In order to work properly the system must be tuned a little off of resonance to be near the maximum power transfer of resonance, but to also be away from the null point. A small change in the inductive fuze setter parameters, such as a drift in capacitance values or inductance values caused by temperature variations can shift the operating point back to resonance, resulting in a null and loss of phase response, so that no talkback message can be interpreted.

BRIEF SUMMARY OF THE INVENTION

The inventive transmitter coil utilizes an "L" shaped coil cross section, with the wrapped coil portion being at right angles to the return coil portion, in order to increase the coupling efficiency between the fuze setter coil and the fuze receiver coil, as compared to the prior art "C" coil. The inventive "L" shaped cross section also eliminates counter magnetic field due to the return coil portion being at right angles to the wrapped coil portion.

The inventive fuze setter includes a controller which is conductively connected to a transmitter and a receiver, the transmitter and receiver each being conductively connected to a first inductive coil, the first inductive coil being part of a resonant LC circuit. The electronic fuze is incorporated into a projectile and includes a second inductive coil in an inductively coupled relationship with the first inductive coil, the fuze including circuitry for sending a talkback message back to the controller using the second inductive coil, the talkback message confirming data sent by the transmitter to the electronic fuze using the first inductive coil. The fuze setter further includes circuitry for adaptively tuning the resonant LC circuit for resonance by adjusting the capacitance in the LC circuit to maximize current in the LC circuit. The inventive fuze setter utilizes a switched capacitor network circuit to tune the LC circuit for resonance. The forward message is transmitted by pulse width modulating a 100 KHz carrier signal and the reverse message is transmitted by pulse code modulating the 100 KHz carrier signal The fuze pulse code modulates the 100 KHz carrier signal by modulating its impedance, by "shorting" its inductance, which the circuit accomplishes by using a transisitor switch. The modulated impedance of the fuze circuit results in changes in the current in the resonant LC circuit of the fuze setter which are detected and interpreted by the fuze setter circuit.

The current difference in the fuze setter circuit is at a maximum at resonance, unlike the prior art phase change. This eliminates the problems of losing the talkback signal due to a null point. Adaptively tuning the fuze setter circuit for each projectile also eliminates any problems due to aging circuitry or temperature variations by ensuring the maximum signal detection for detecting and interpreting the talkback message.

The inventive system also utilizes a positioning mechanism, which is comprised of two proximity sensors and a vertical stepper motor driven linear cylinder for vertical motion and a solenoid with guide rods for horizontal motion. The positioning mechanism positions the fuze setter so that each projectile is inductively coupled with the fuze setter as the projectile moves from the magazine to the cannon. The positioning mechanism allows the fuze setter to maintain a fire rate of at least 10 rounds per minute and handle projectiles up to 1000 mm.

DETAILED DESCRIPTION OF THE INVENTION

While this invention may be embodied in many different forms, there are described in detail herein specific preferred embodiments of the invention. This description is an exemplification of the principles of the invention and is not intended to limit the invention to the particular embodiments illustrated.

Figure 1:
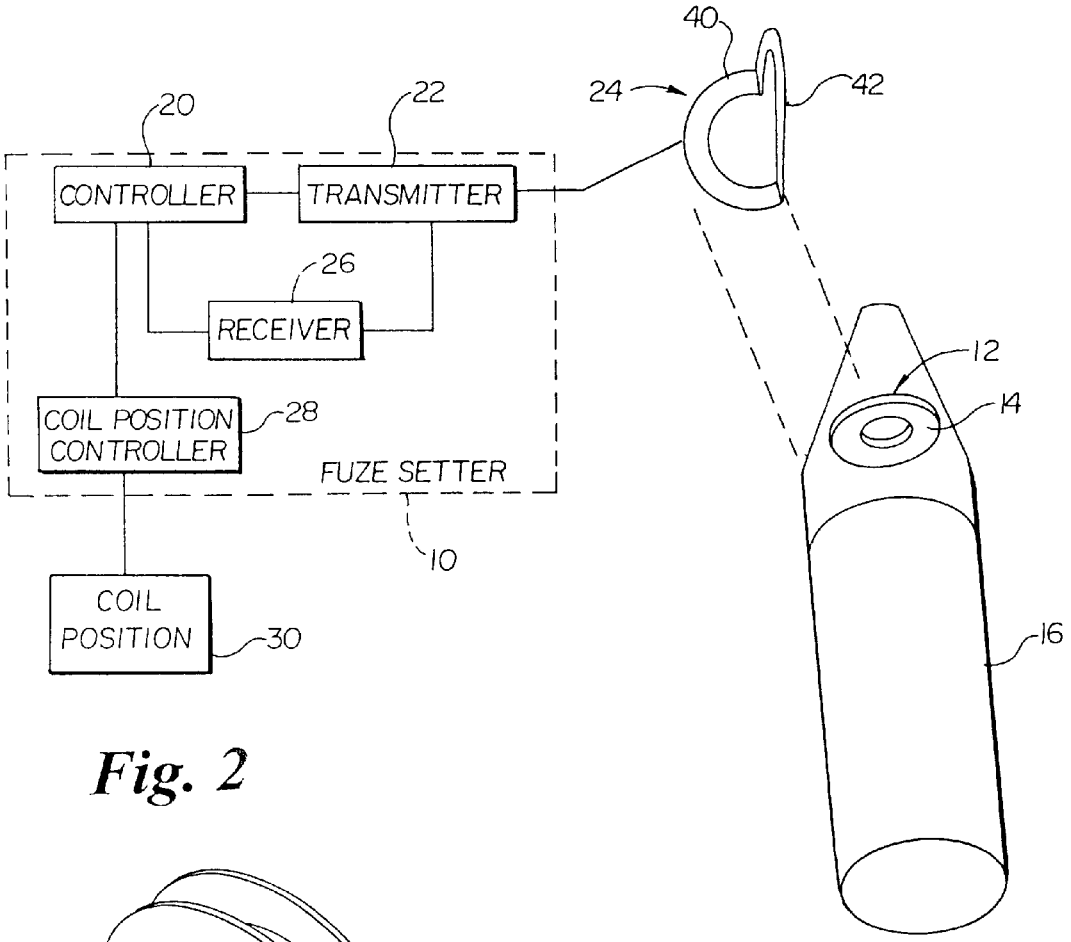
FIG. 1 is a schematic diagram showing the inventive transmitter coil and a block diagram of the fuze setter.

The electronic fuzing system of the present invention includes, as seen in FIG. 1, a fuze setter, generally shown at 10, and an electronic fuze, generally indicated at 12. The electronic fuze 12 incorporates a receiver coil 14 and the fuze 12 is incorporated into a projectile 16. Electronic fuzes, receiver coils and projectiles are well known in the art.

Figure 5:
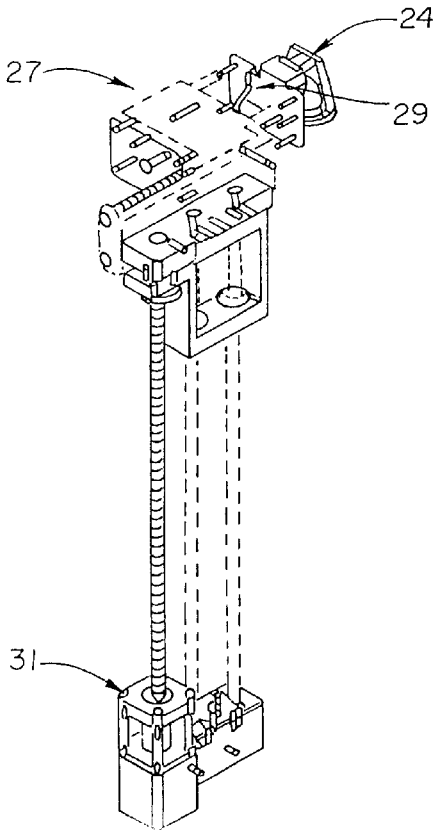
FIG. 5 shows the coil positioning mechanism.
Figure 6:
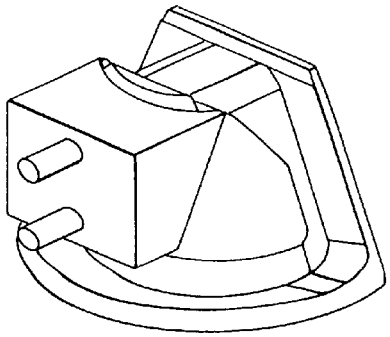
FIG. 6 shows the coil attached to the coil positioning mechanism.

The fuze setter 10 of FIG. 1 includes a controller 20, which is conductively connected to a transmitter 22. The inventive transmitter coil is shown generally at 24 and is conductively connected to both transmitter 22 and a receiver 26. The fuze setter 10 is positioned relative to the projectile 16 by a coil position controller 28 which controls a coil positioner 30. As shown in FIG. 5, the coil positioner 30 consists of two proximity sensors 27 and 29 and a vertical stepper motor driven linear cylinder 31 for vertical motion and a solenoid with guide rods for horizontal motion. The proximity sensors 27 and 29 detect the extend and the retract positions of the solenoid. FIG. 6 shows the coil 24 attached to the coil positioning meachanism 30 in greater detail.

The inventive transmitter coil 24 is comprised of a wrapped coil portion 40 and a return coil portion 42. The wrapped coil portion 40 wraps around 180° of the circumference of the projectile adjacent the receiver coil 14, such that the wrapped coil portion 40 and receiver coil 14 are substantially coplanar. The return coil portion 42 is at 90° to the wrapped coil portion 40, giving the coil 24 an "L" shaped cross section. Testing by applicant has shown that the "L" shaped coil 24, with the wrapped portion extending 180° around the circumference provides a better coupling coefficient than the prior art "C" coil. In testing, the "C" coils coupling coefficient was 0.070, while the "L" shaped coil had a coupling coefficient ranging from 0.091 to 0.110. This coupling coefficient is better than any coil design applicant is aware of, except the donut coil used in hand held fuze setters, which cannot be used in connection with rapid-fire cannon fuze setters due to space constraints.

Figure 2:
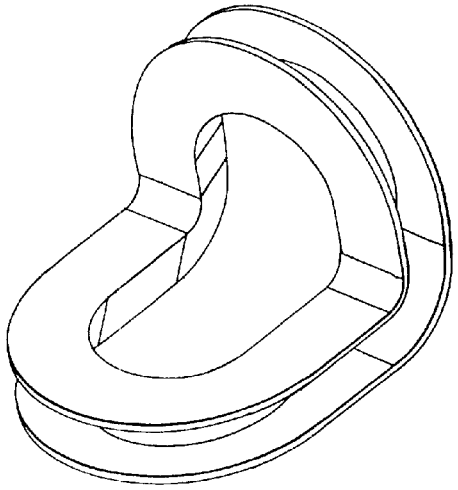
FIG. 2 shows the "L" shaped coil in more detail.
Figure 3:
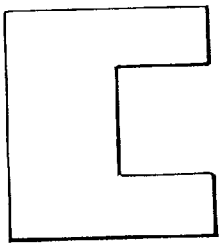
FIG. 3 shows a prior art "C" shaped coil.

The "L" shaped coil is shown in more detail in FIG. 2 and a prior art "C" shaped coil is shown in FIG. 3.

Figure 4:
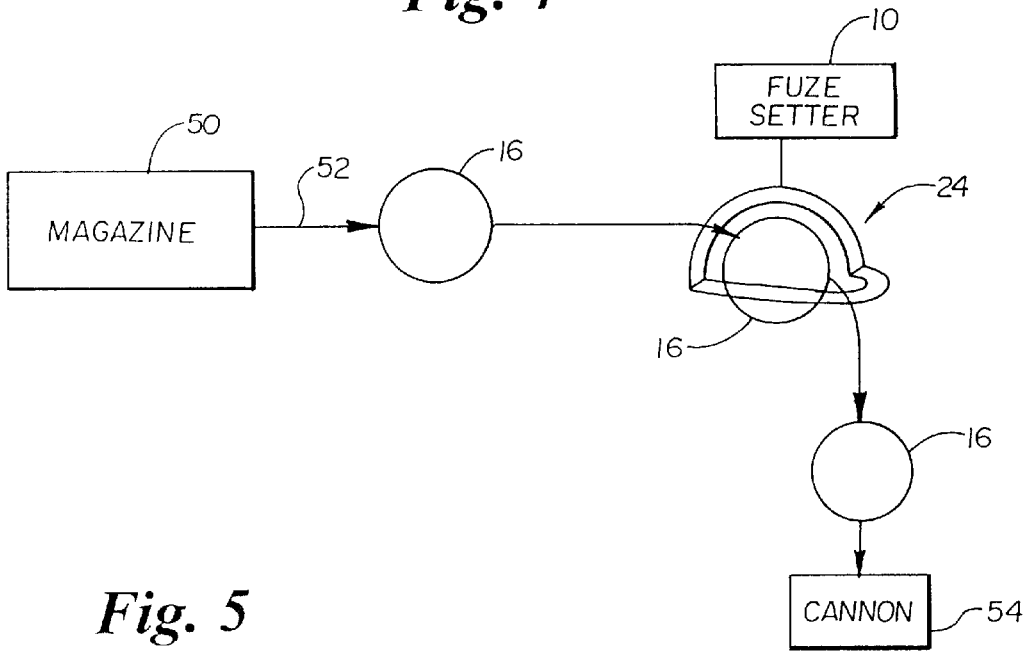
FIG. 4 is a schematic diagram showing implementation of the system of FIG. 1 for ammunition rounds moving along a feedpath from a magazine to a rapid-fire cannon.

A rapid-fire cannon fuze setting system is shown in FIG. 4, in which a magazine is shown at 50, and a feed mechanism shown at 52 moves the projectiles 16 and loads them in canon 54. The fuze setter 10 is part of the loader and moves with the loader to the projectile in the magazine so that the fuze setter 10 is placed in an inductively coupled relationship, and this is discussed more fully above in connection with FIG. 5. The fuze setter 10 transmits the detonation data to the fuze 12 in the projectile 16 using transmitter coil 24, the fuze 12 confirms its detonation data with a talkback signal and the projectile is fed to the cannon 54. Cannon 54 has a fire rate of up to 10 rounds per minute.

Figure 7:
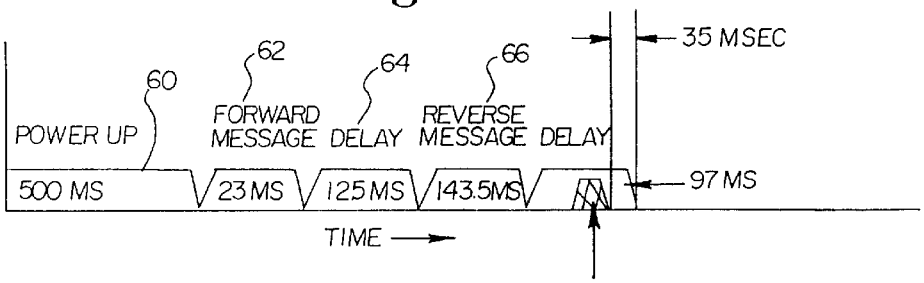
FIG. 7 is a timing diagram showing the communications between the fuze setter and a typical fuze (XM782)
Figure 8:
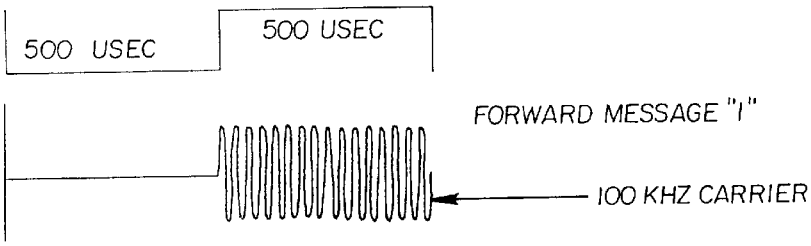
FIG. 8 shows a timing diagram of a forward message "1"
Figure 9:
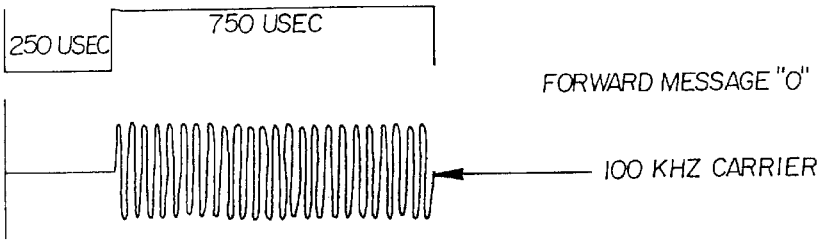
FIG. 9 shows a timing diagram of a forward message "0"
Figure 10:
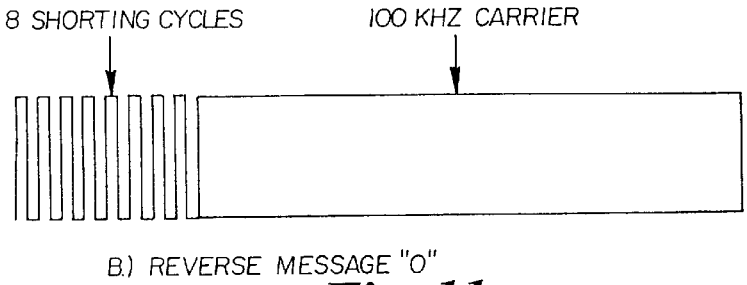
FIG. 10 shows a timing diagram of a reverse or talkback message "0"
Figure 11:
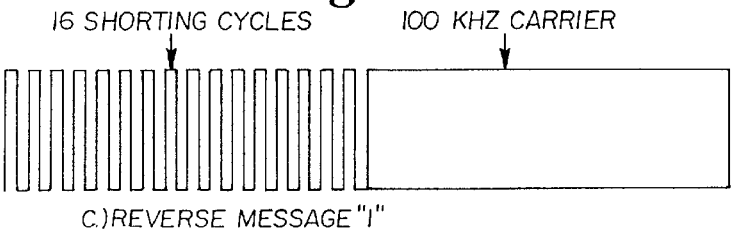
FIG. 11 shows a timing diagram of a reverse or talkback message "1"

FIGS. 7–9 show the communications governed by STANAG 4369 and AOP-22 in more detail. The entire communication is shown in FIG. 7, in which the power up phase is shown at 60, which provides power to and charges up the fuze circuit 12, as is well known in the art. The forward message containing detonation data is shown at 62, a delay is shown at 64 the reverse or talkback message is shown at 66. The communication scheme shown in FIG. 7 is well known in the art. The forward message "1" is a pulse width modulation (PWWM) scheme which turns the 100 KHz carrier on and off at precise intervals. A logic "1" is characterized by a 50% duty cycle pulse and a logic "0" is characterized by a 75% duty cycle pulse, shown respectively in FIG. 8 and FIG. 9. The reverse or talkback message generated by the fuze 12 is a pulse code modulated (PCM) signal produced by the fuze shorting its inductive set circuitry at precise intervals. The individual pulses have a 50% duty cycle as shown in FIG. 10 and FIG. 11. Each logical "bit" of information consists of 8 or 16 pulses within a time window equal to 32 times the period of a single pulse. Eight pulses represent a logical "0", as shown in FIG. 10 and 16 pulses represent a logical "1", as shown in FIG. 11.

Figure 12:
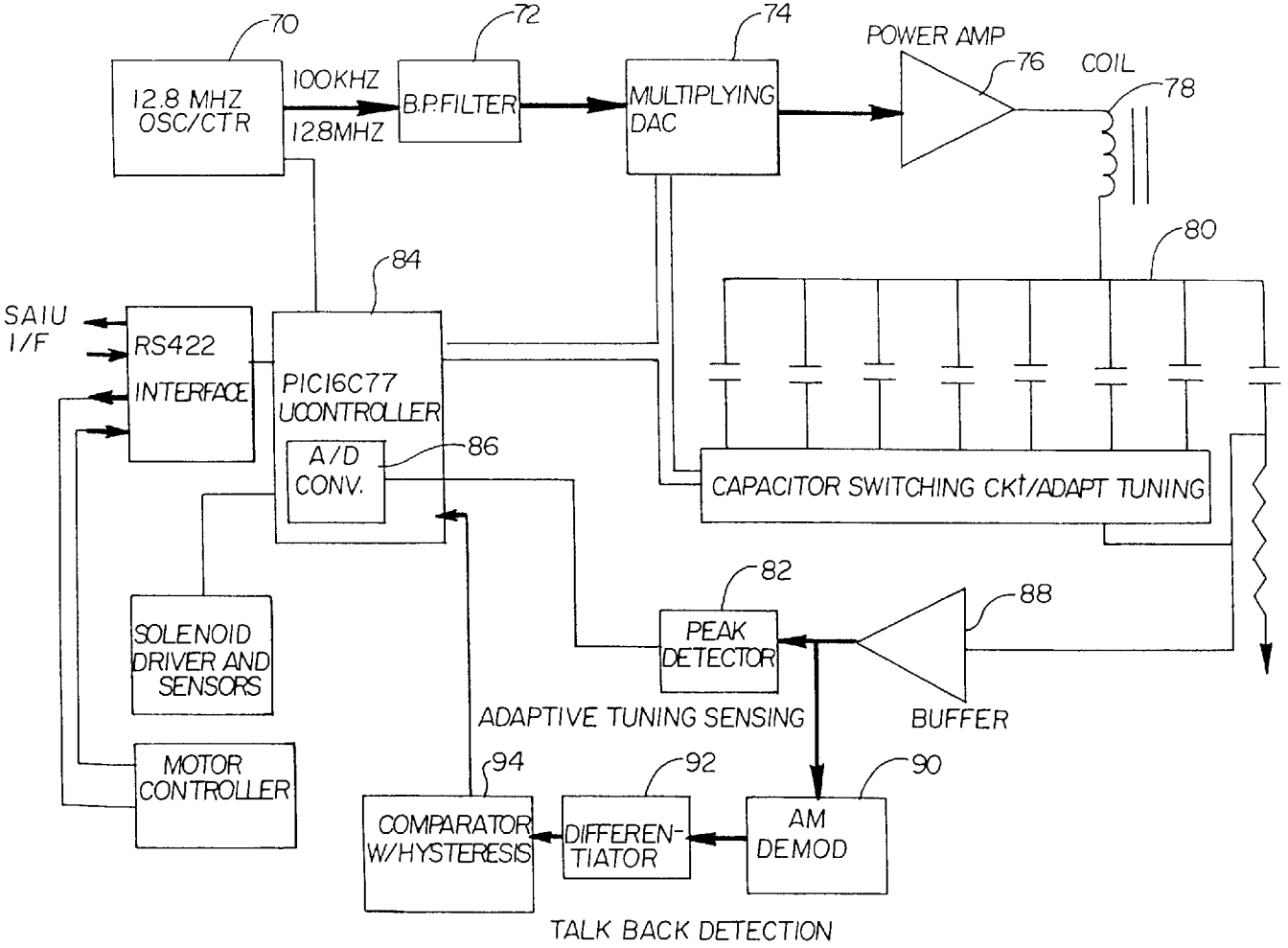
FIG. 12 shows a circuit block diagram of the fuze setter circuitry.

FIG. 12 shows a high level block diagram of the circuitry of fuze setter 10. An oscillator 70 generates the 100 KHz carrier signal, which is filtered at 72, converted from digital to analog at 74 and amplified at 76. The transmitter coil is shown at 78 which forms an LC resonant circuit in connection with the tuning capacitance circuitry 80. The circuitry is tuned for resonance in connection with each projectile by using peak detector 82 to detect the maximum current in connection with different capacitor values for 80. The circuit is controlled by microcontroller 84, which is connected to peak detector 82 via analog-to-digital converter 86. In addition to routing the buffered voltage 88 to peak detector 82, the buffered voltage 88 is also routed to AM demodulator 90, which is connected to a differentiator 92, which is connected to a comparator 94, which is in turn connected to controller 84.

Figure 13:
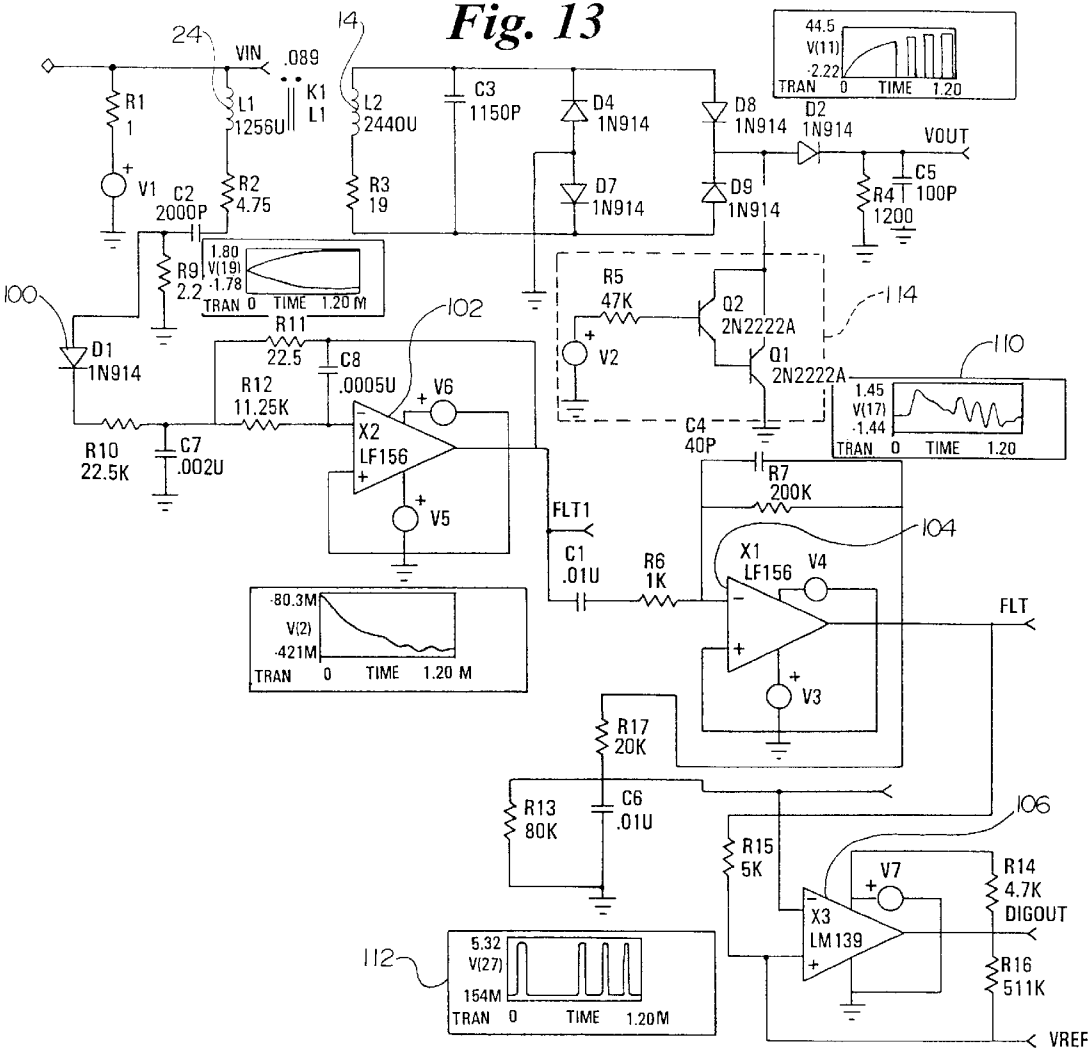
FIG. 13 shows a more detailed circuit diagram of the circuitry of the fuze setter and fuze.

FIG. 13 shows a circuit diagram of the fuze setter and fuze circuitry, with waveforms shown at various points. The transmitter coil 24 is shown inductively coupled to receiver coil 14. The demodulator 90 consists of diode D1, shown at 100 and active filter OP AMP X2 shown at 102, along with their associated resistors and capacitors. The differentiator 92 consists of OP AMP X, shown at 104, which is connected to comparator X3, shown at 106, along with their associated resistors and capacitors. The current waveform, showing the results of talkback modulation is shown at 108. The output of the AM demodulator 90 and differentiator 92 is shown at 110, and the final digitized output is shown at 112. The "shorting" circuitry used by the fuze 12 to generate the talkback message consists of the circuitry shown in the dotted lines at 114.

Figure 14:
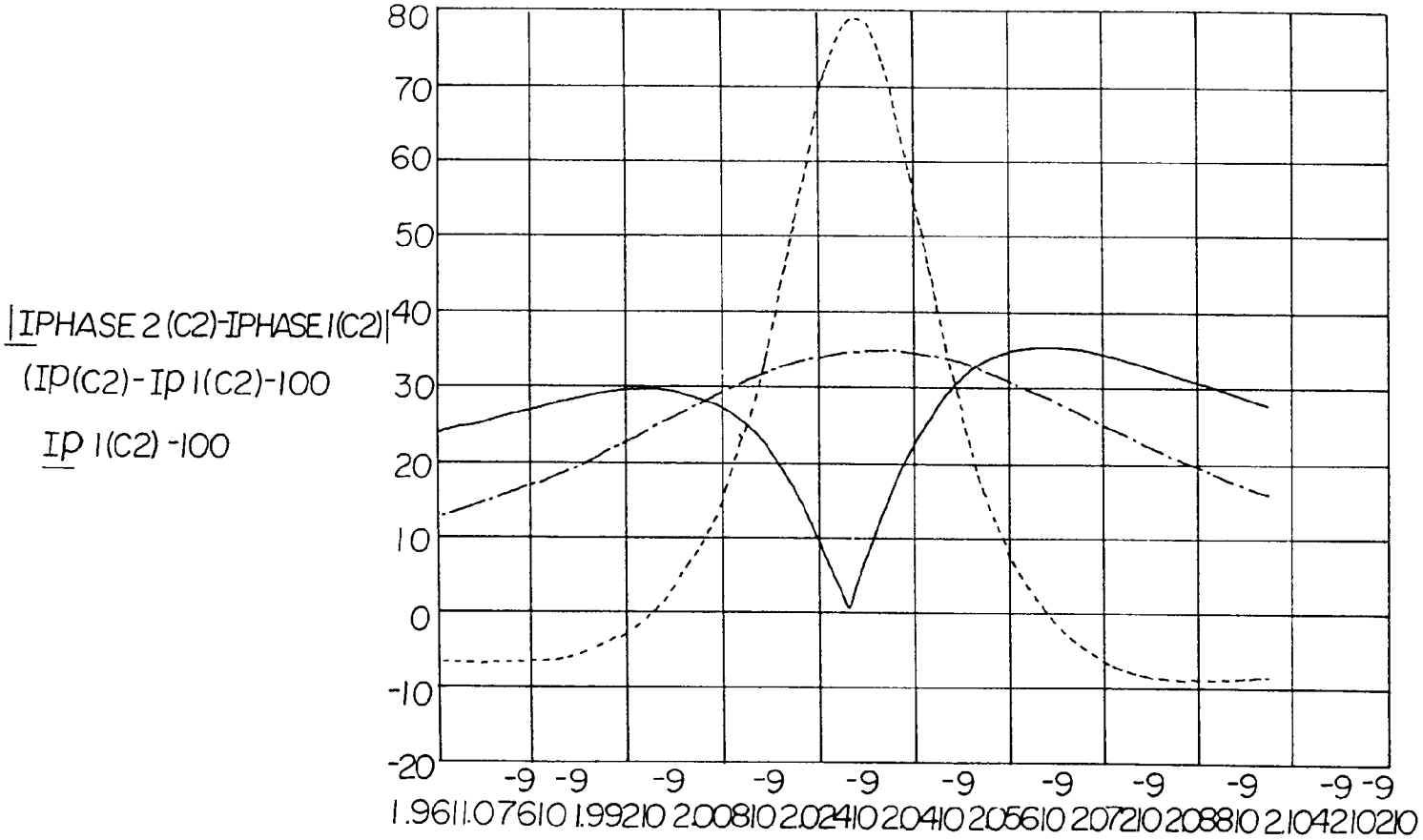
FIG. 14 is a graph of the current difference; phase difference and current as a function of the tuning capacitors.

FIG. 14 shows a graph of the current difference; phase difference and current as a function of the tuning capacitors. As can be seen, the phase difference goes through a null at the resonant point, which is defined by the current Ip1 peaking. Also, it can be seen that the current difference peaks at resonance.

Figure 15:
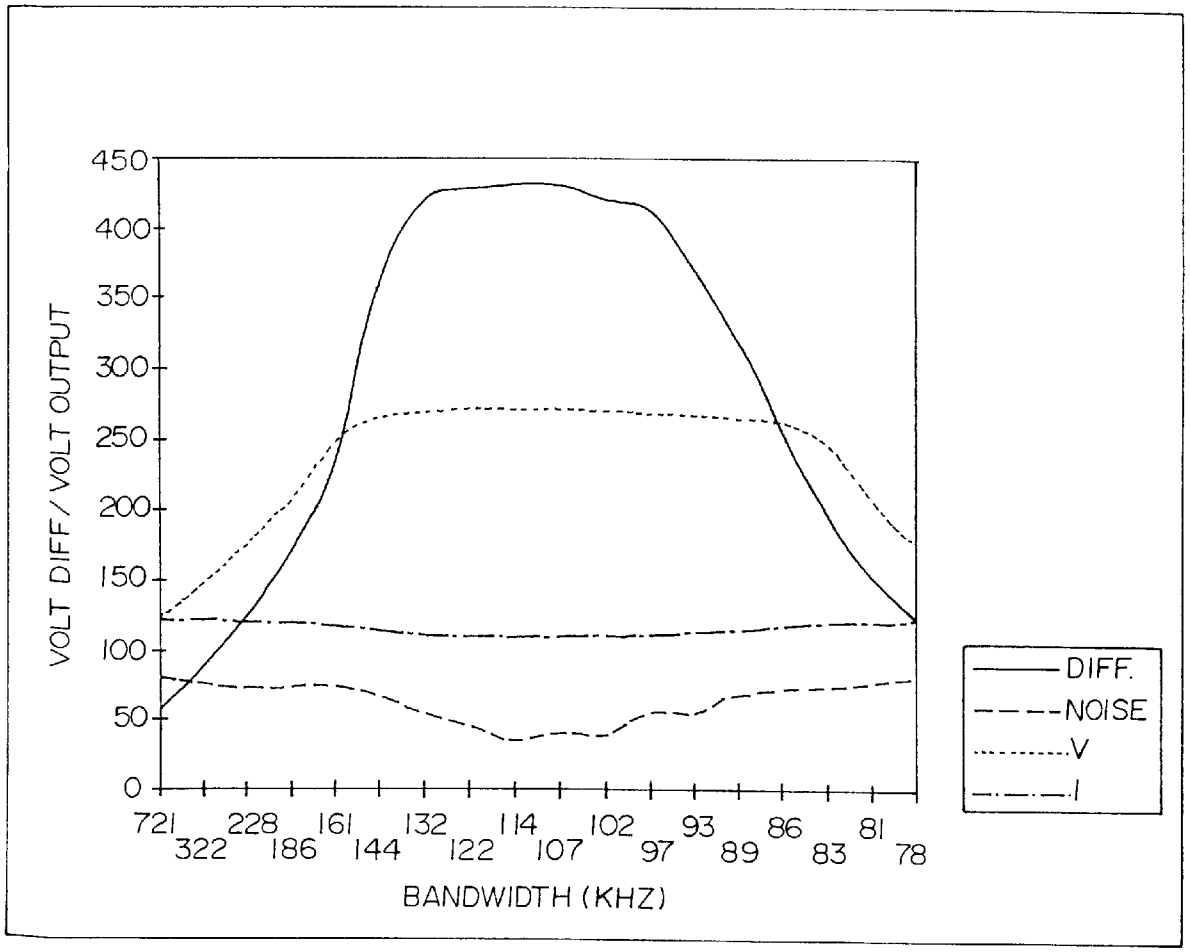
FIG. 15 is a graph of actual data of the voltage difference and the fuze output voltage for different values of capacitor in the fuse.
Figure 16A:
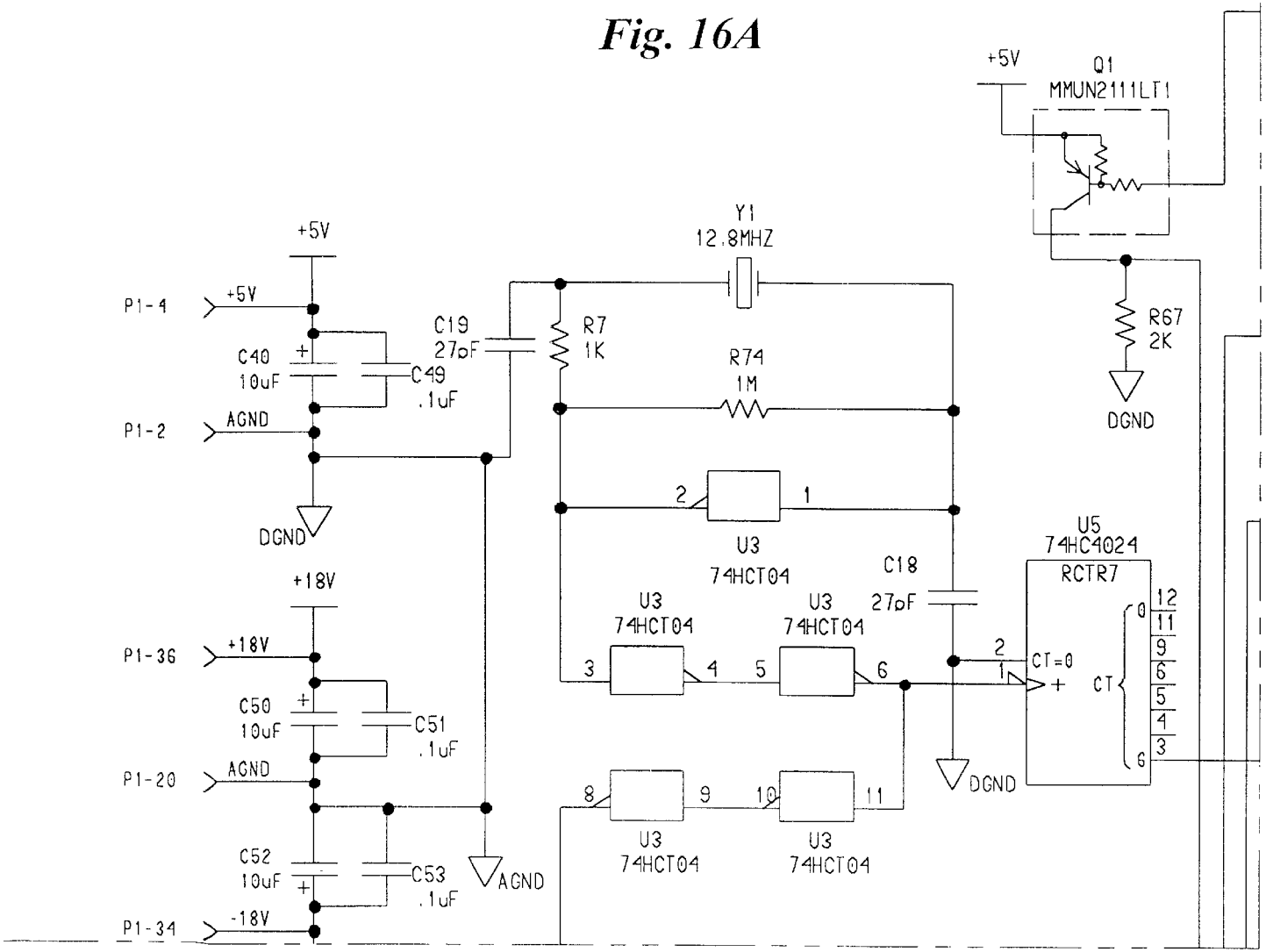
FIG. 16 is a detailed circuit diagram of the fuze setter circuitry.
Figure 16B:
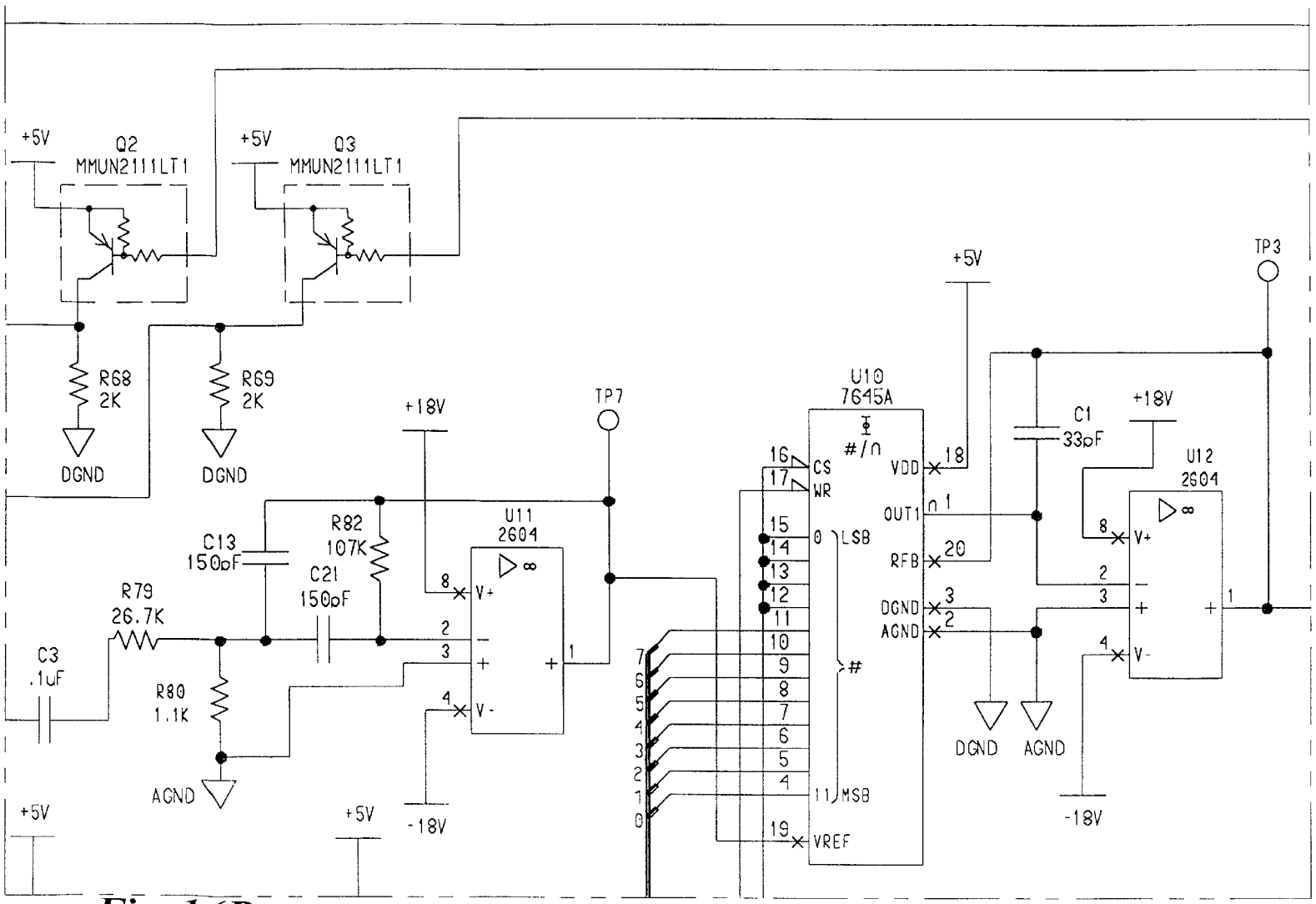
Figure 16C:
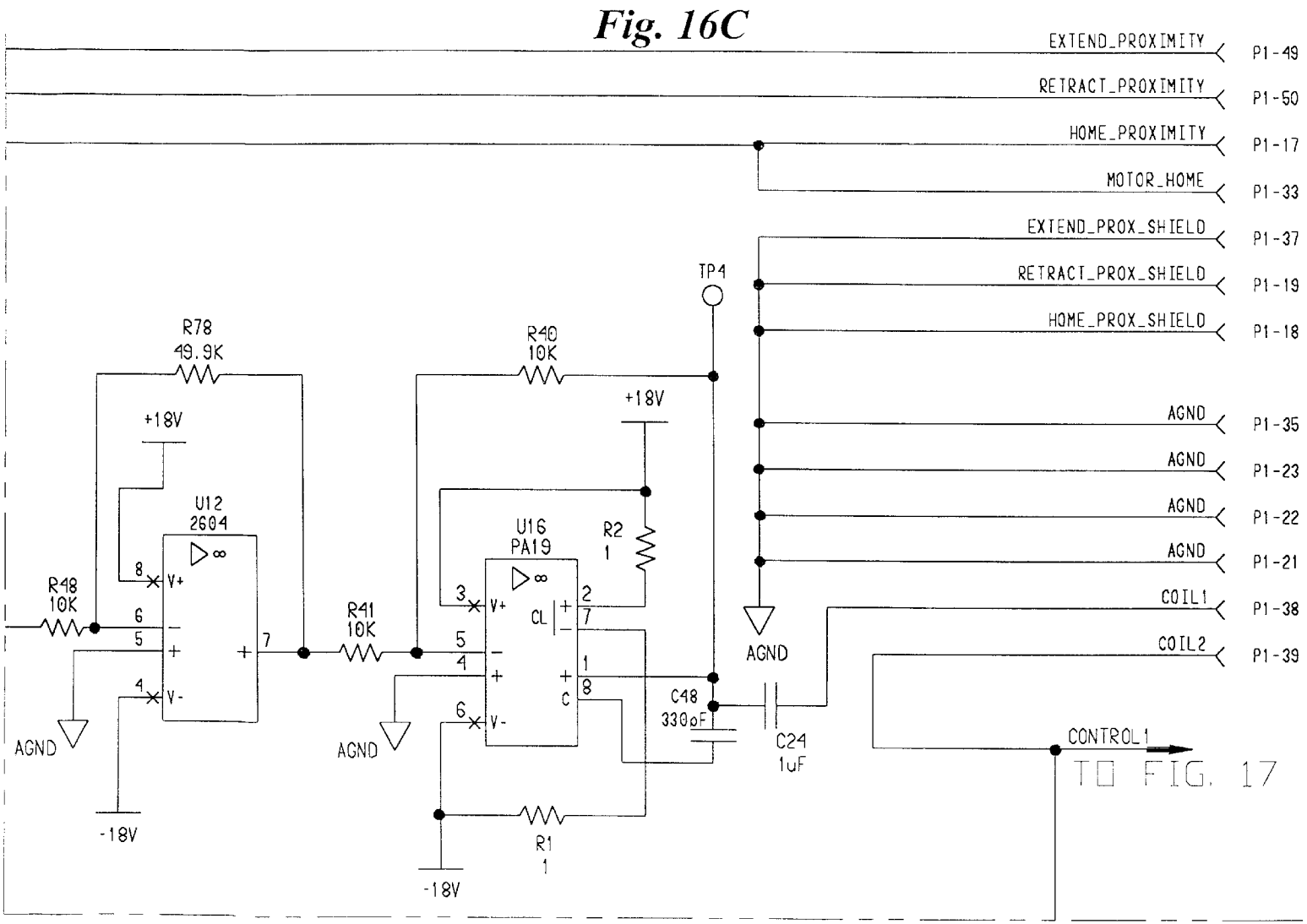
Figure 16D:
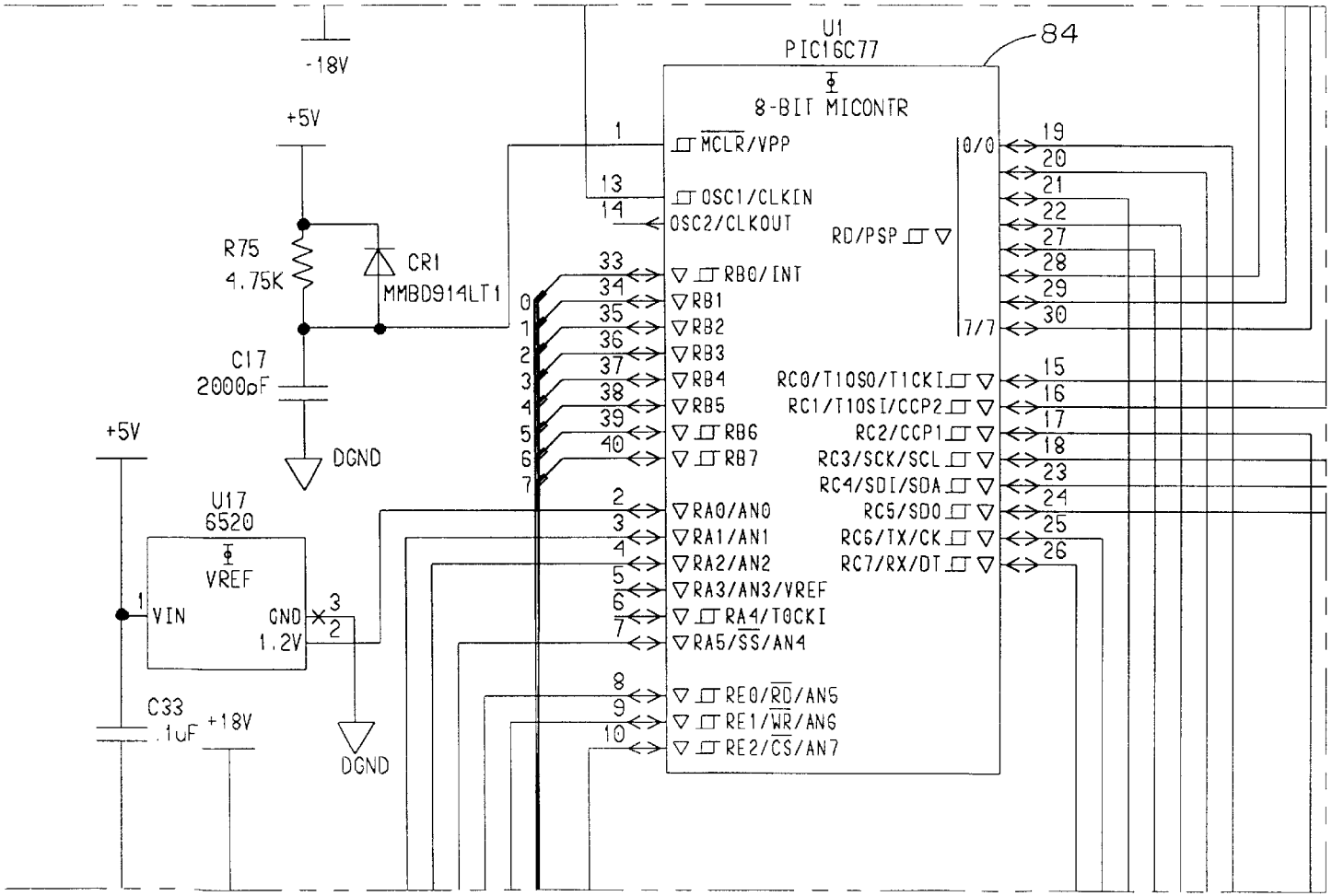
Figure 16E:
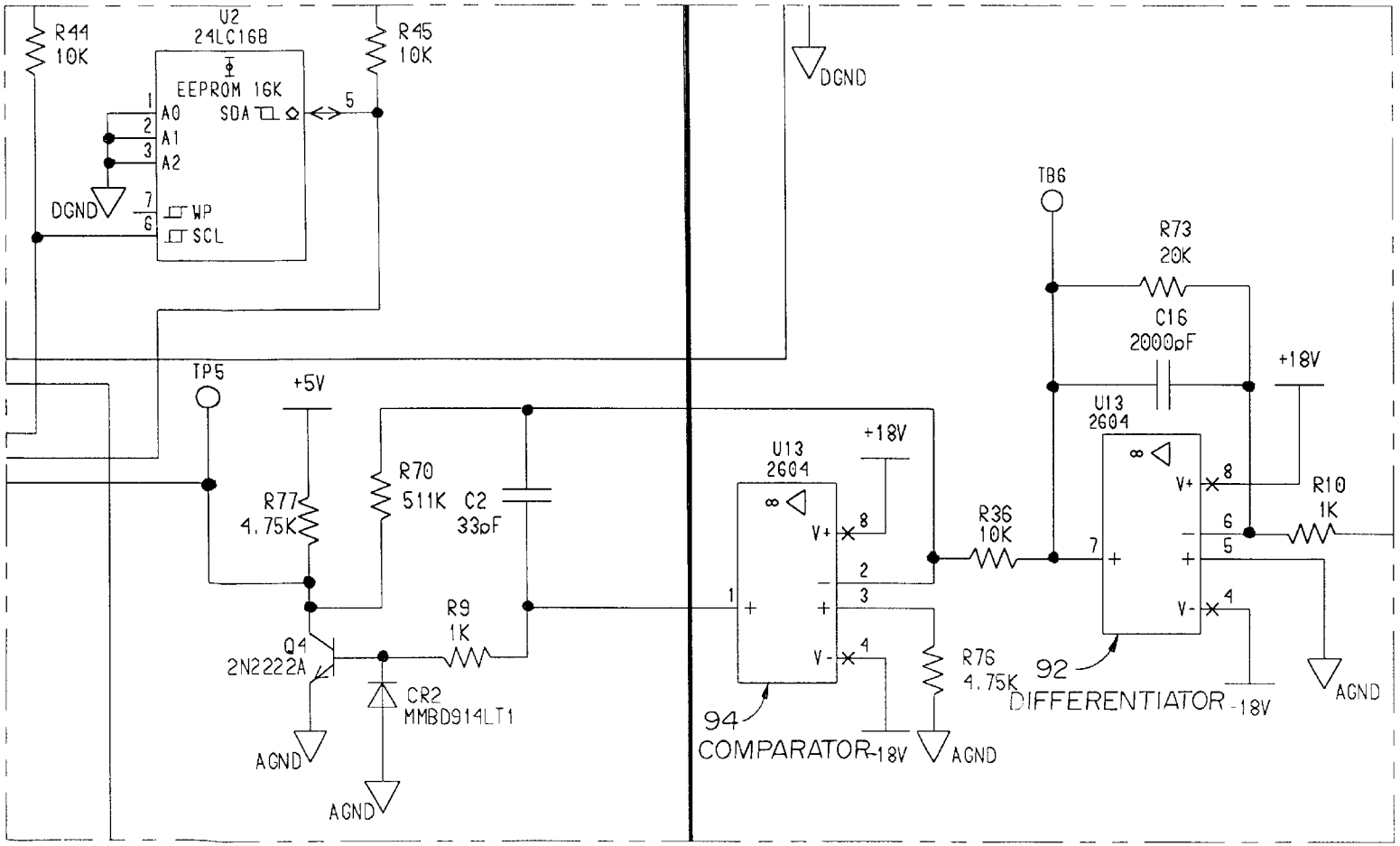
Figure 16F:
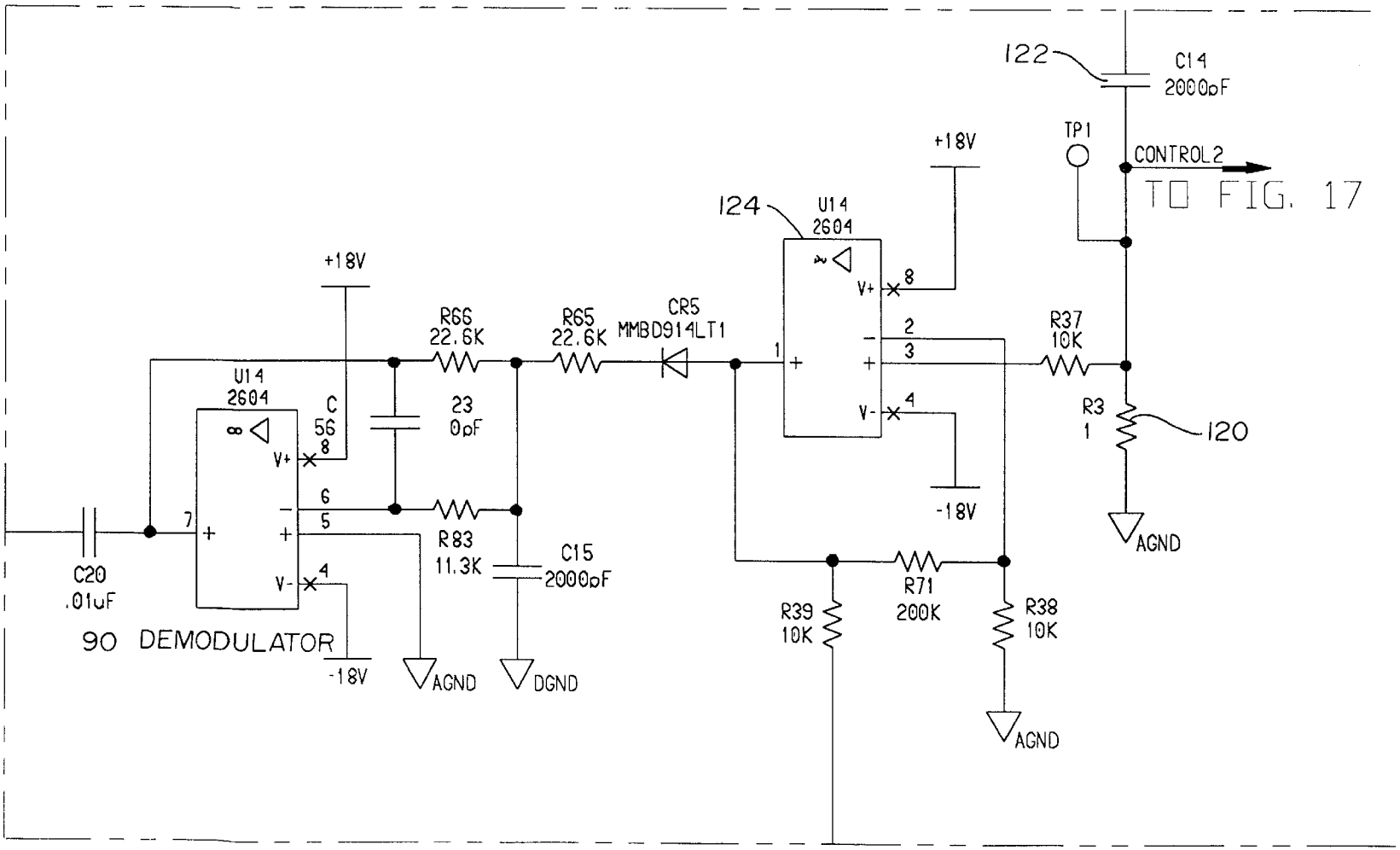
Figure 16G:
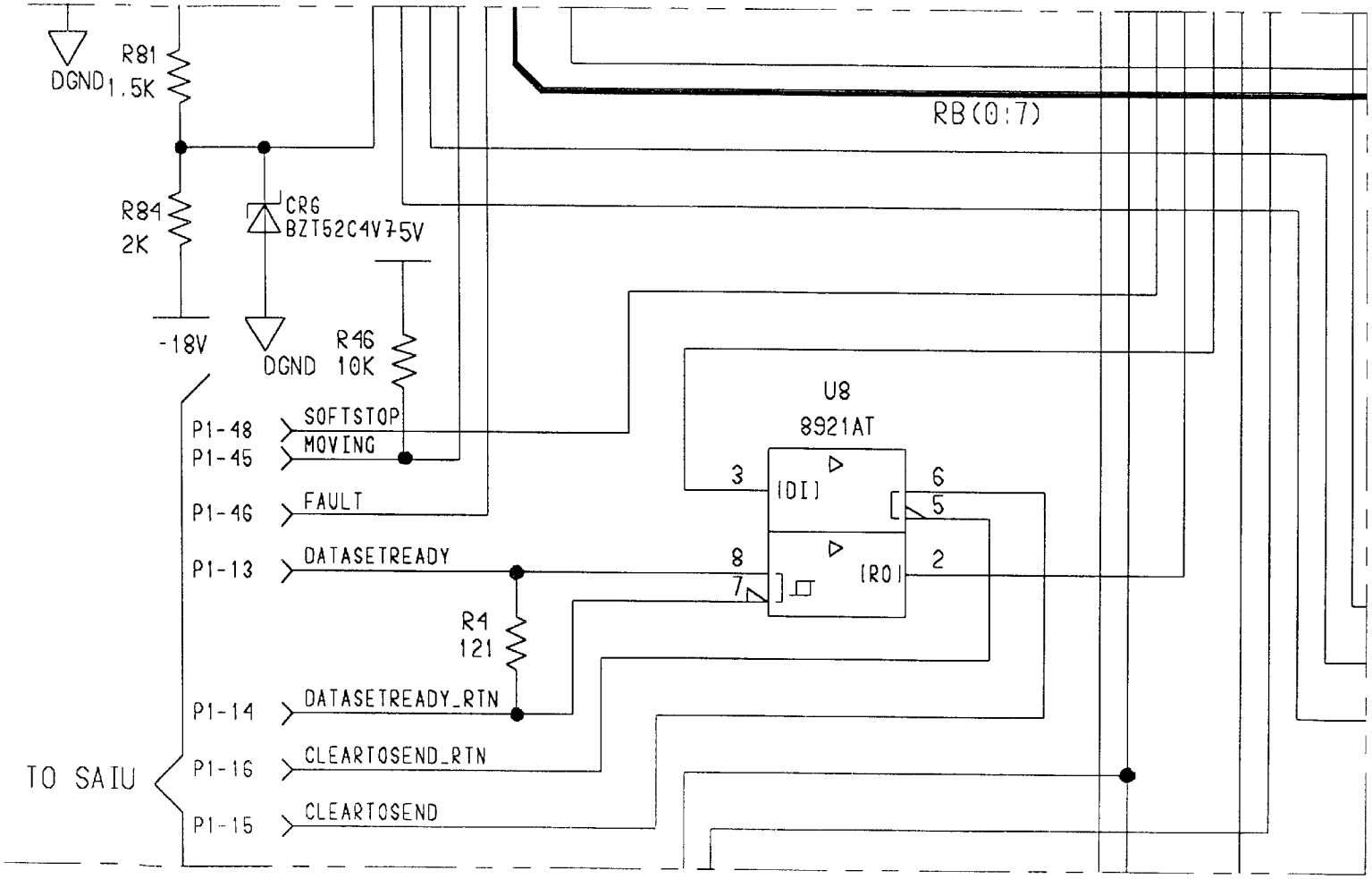
Figure 16H:
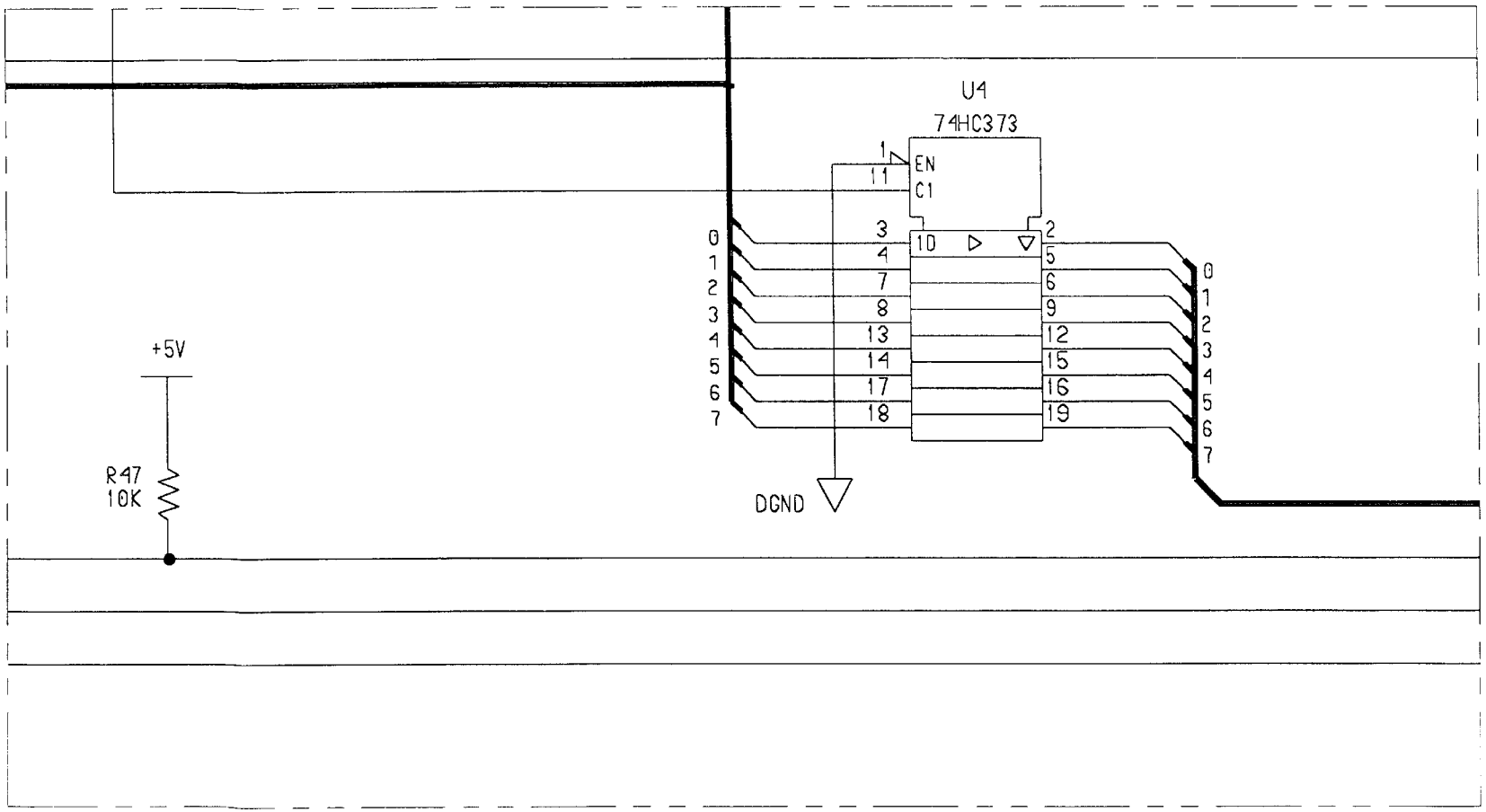
Figure 16I:
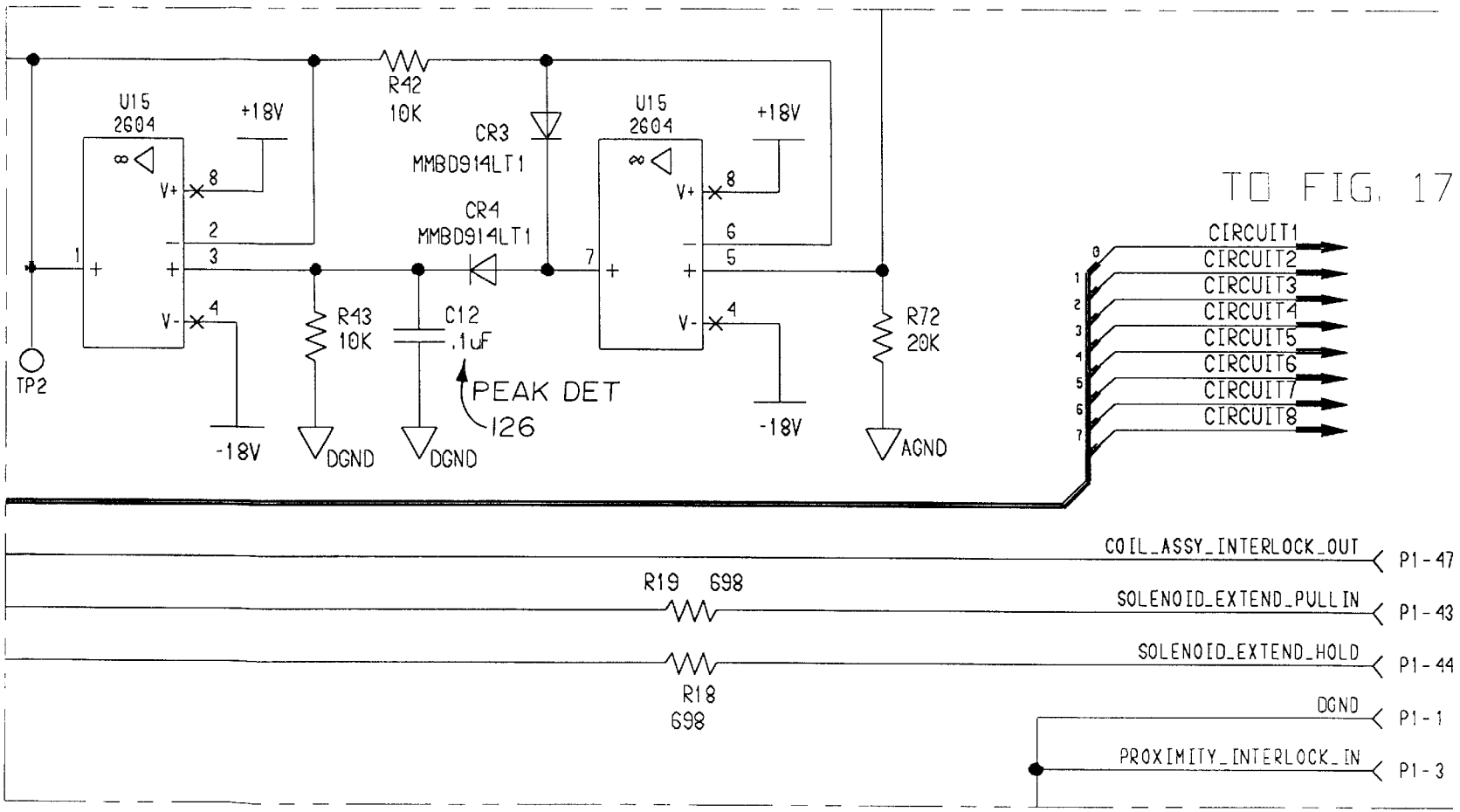
Figure 16J:
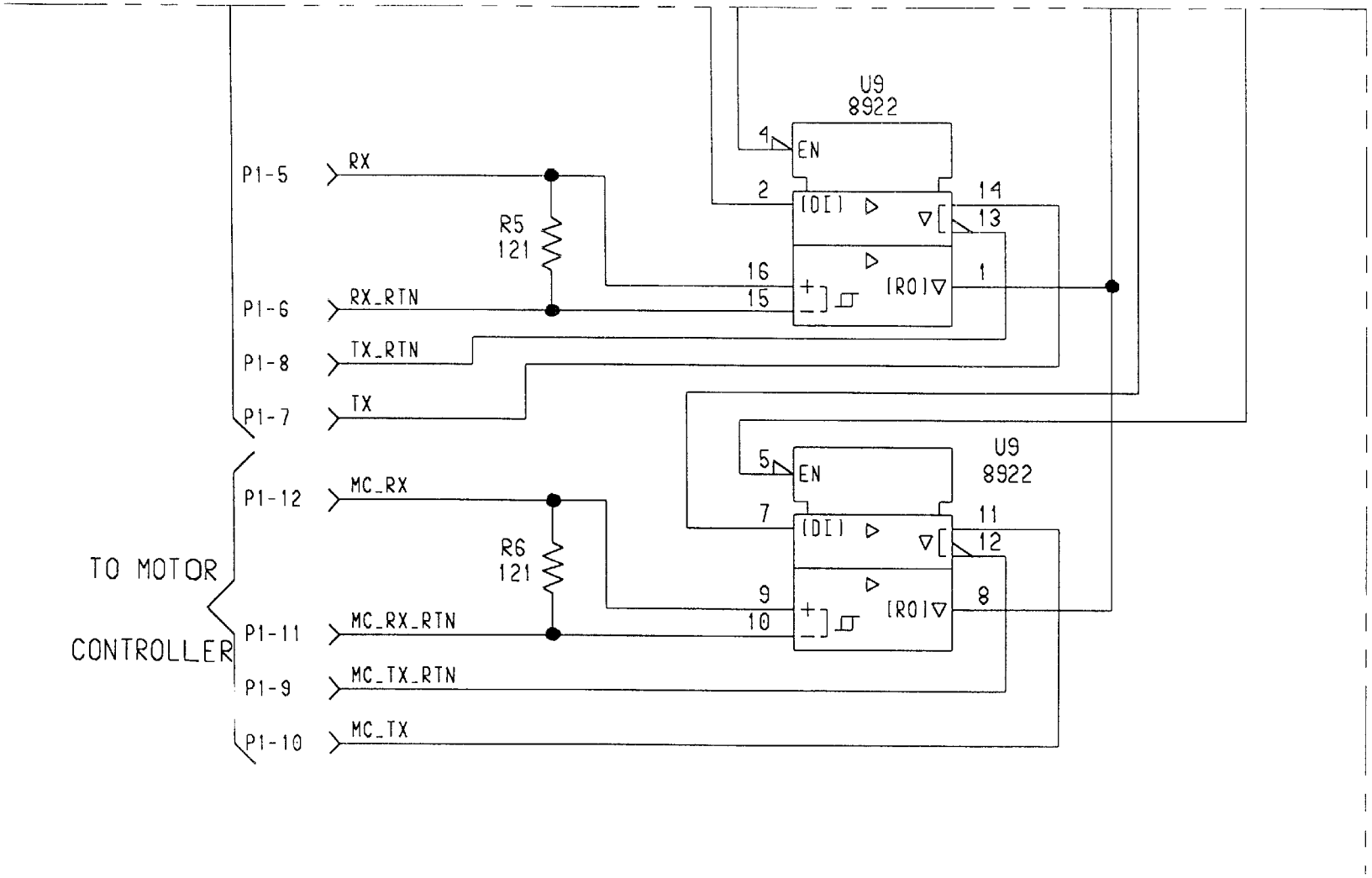
Figure 16K:
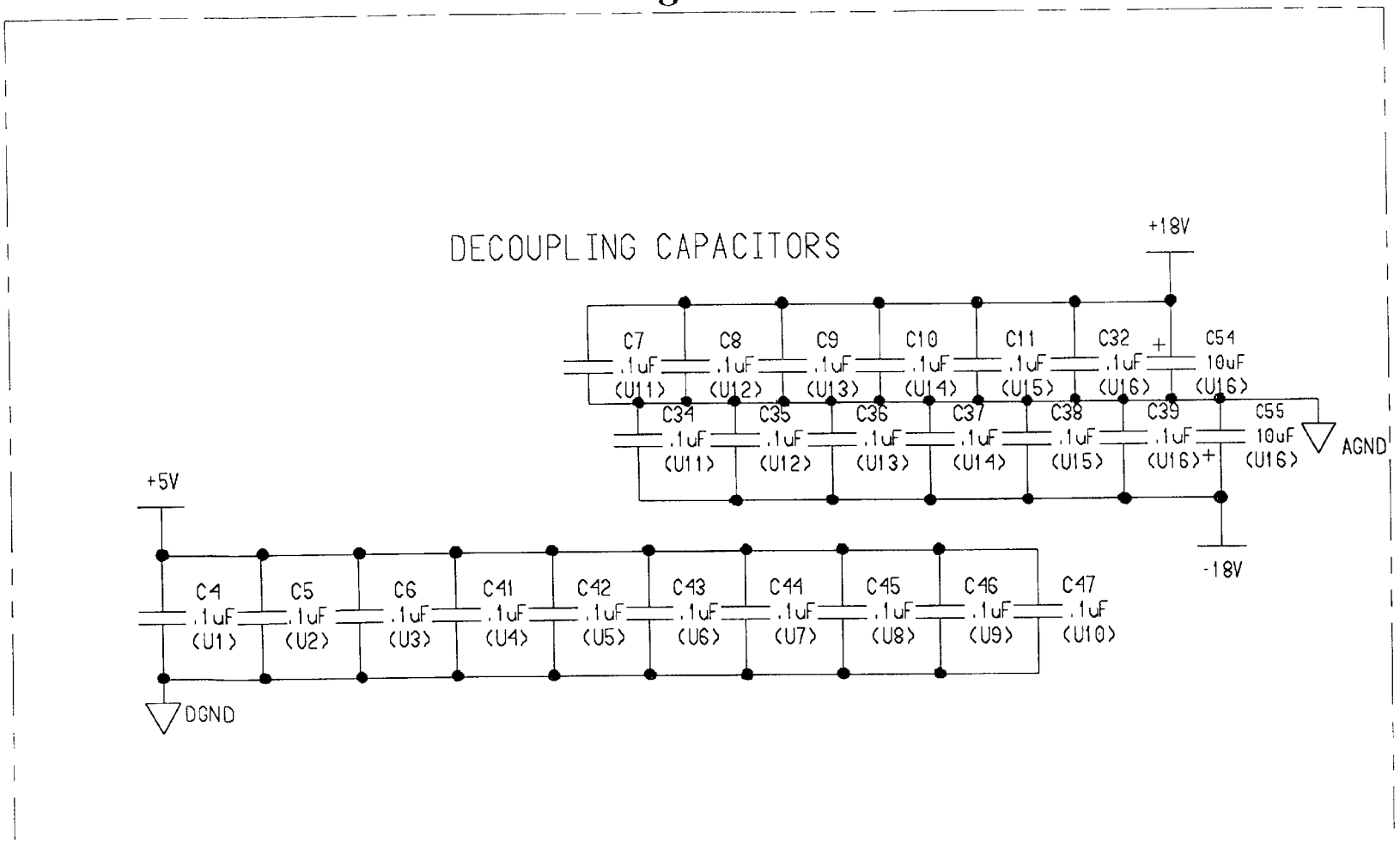
Figure 16L:
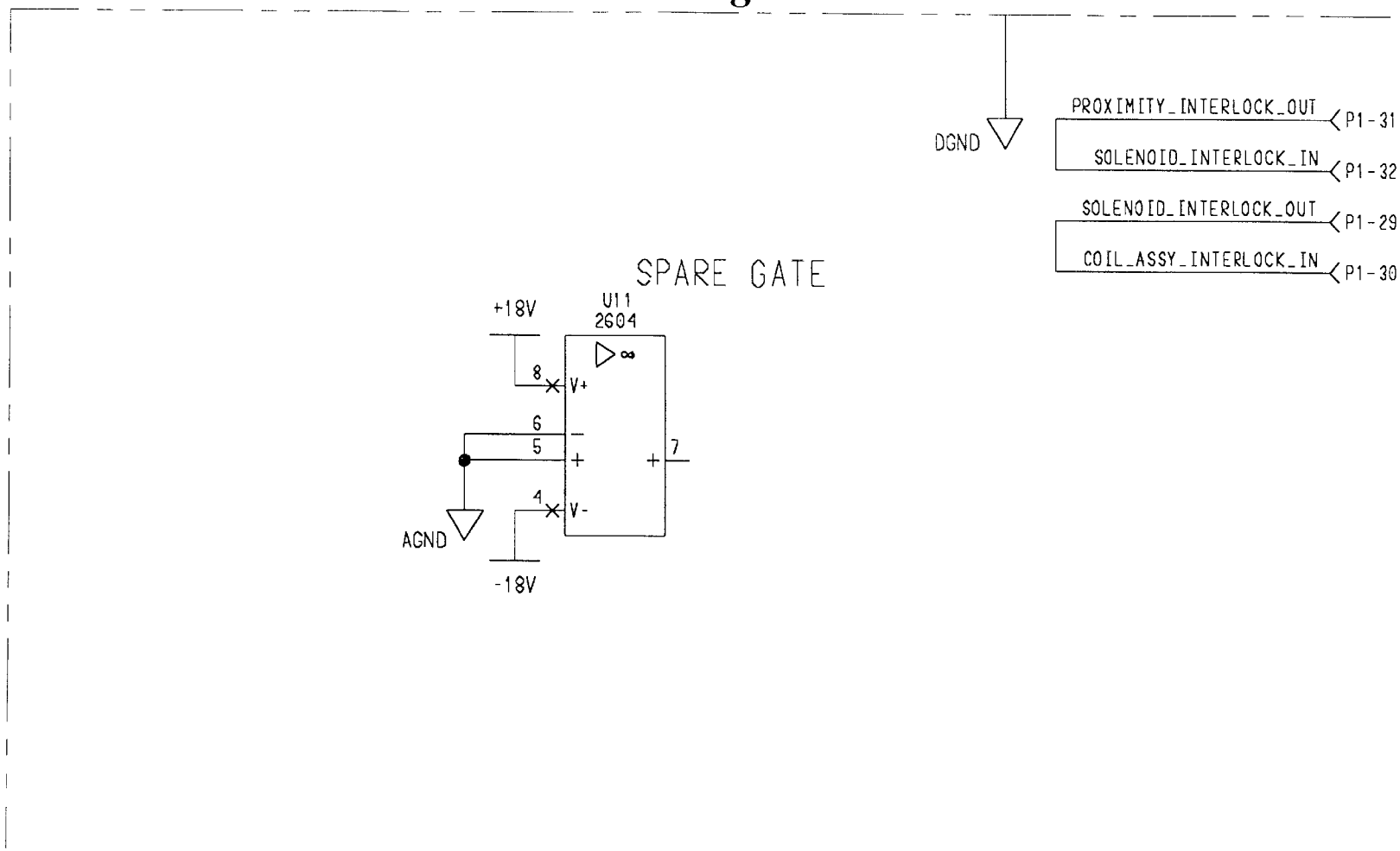
Figure 17A:
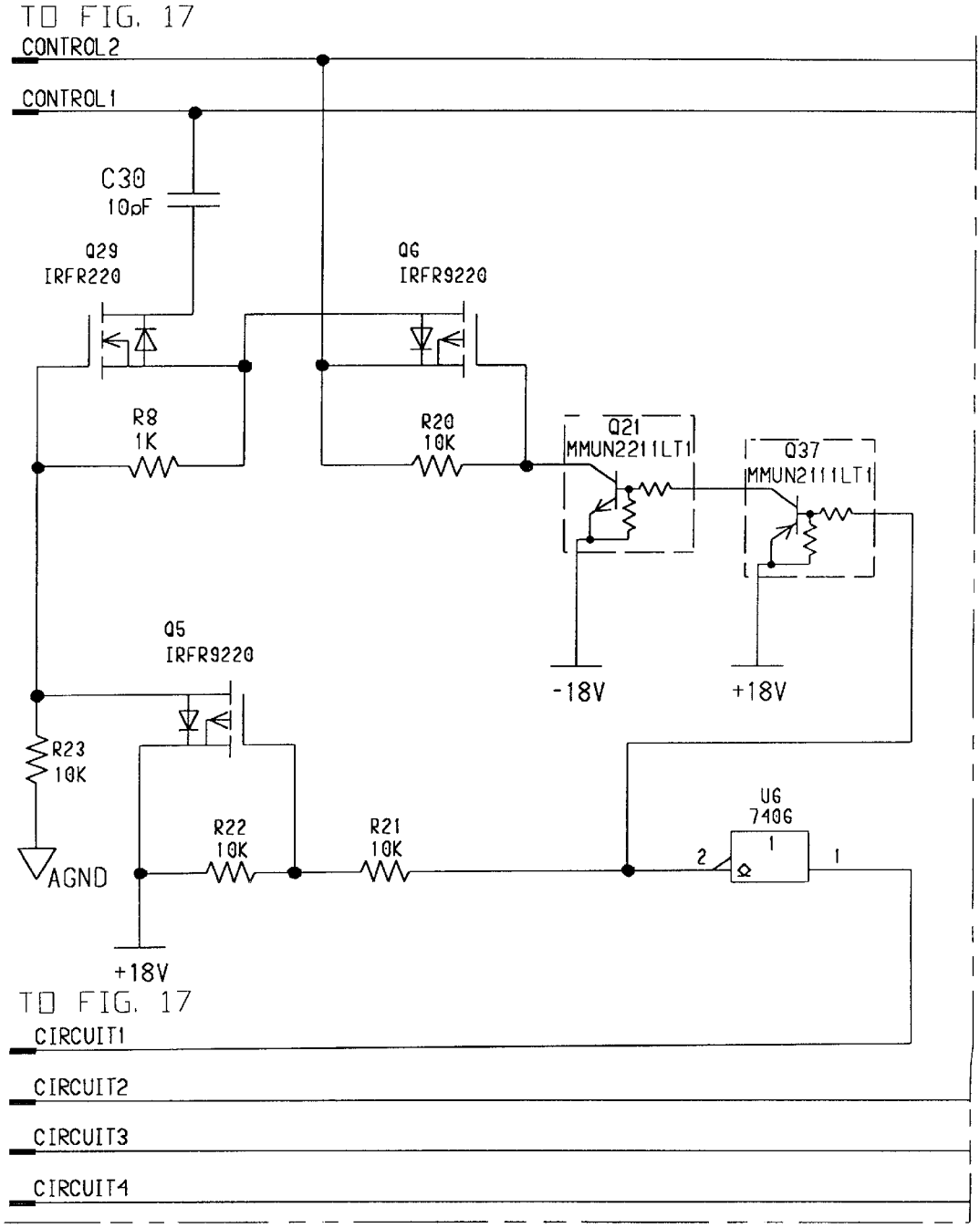
FIG. 17 is a detailed circuit diagram of the switched capacitor circuit, used for tuning the capacitance of the LC circuit for resonance.
Figure 17B:
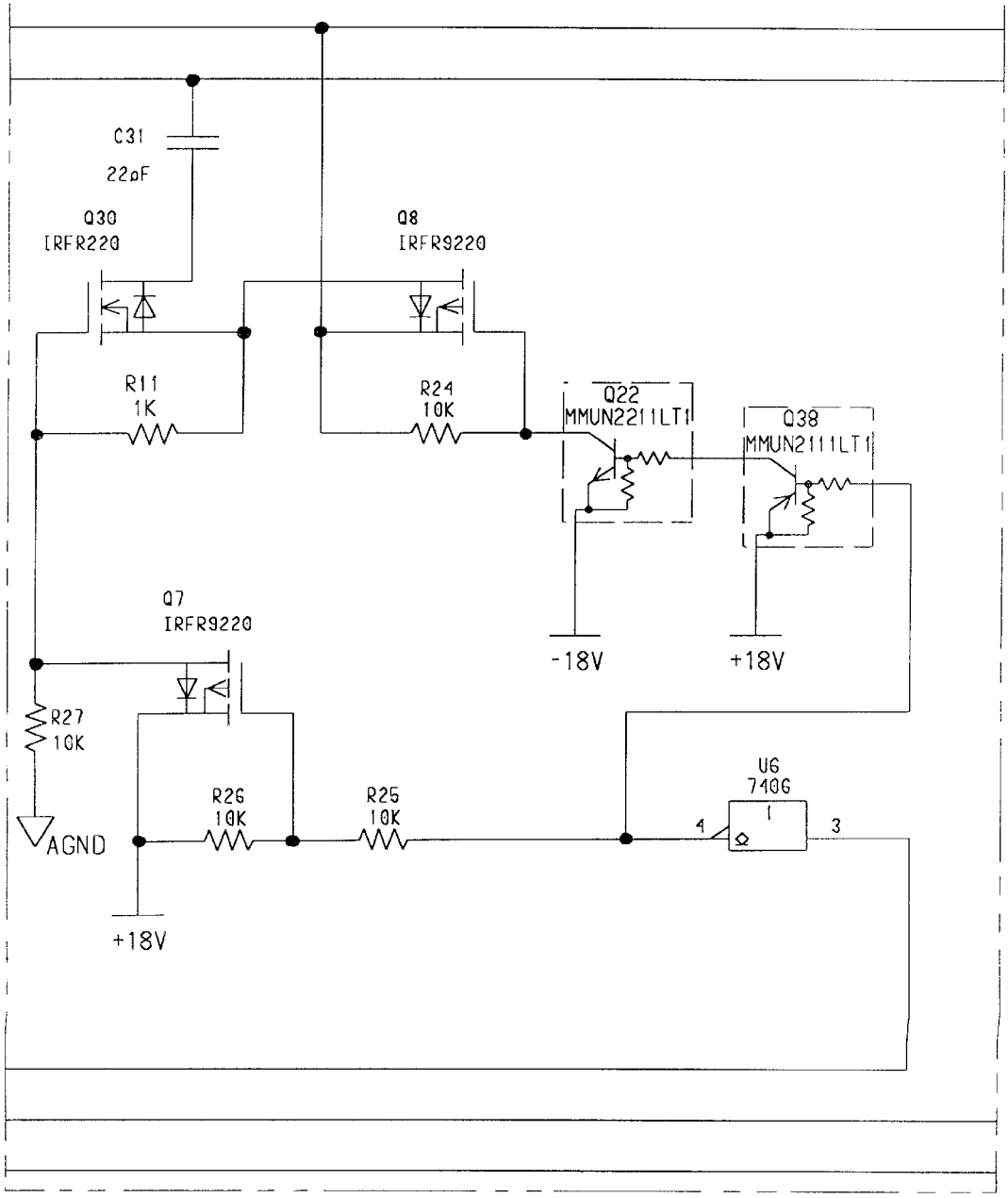
Figure 17C:
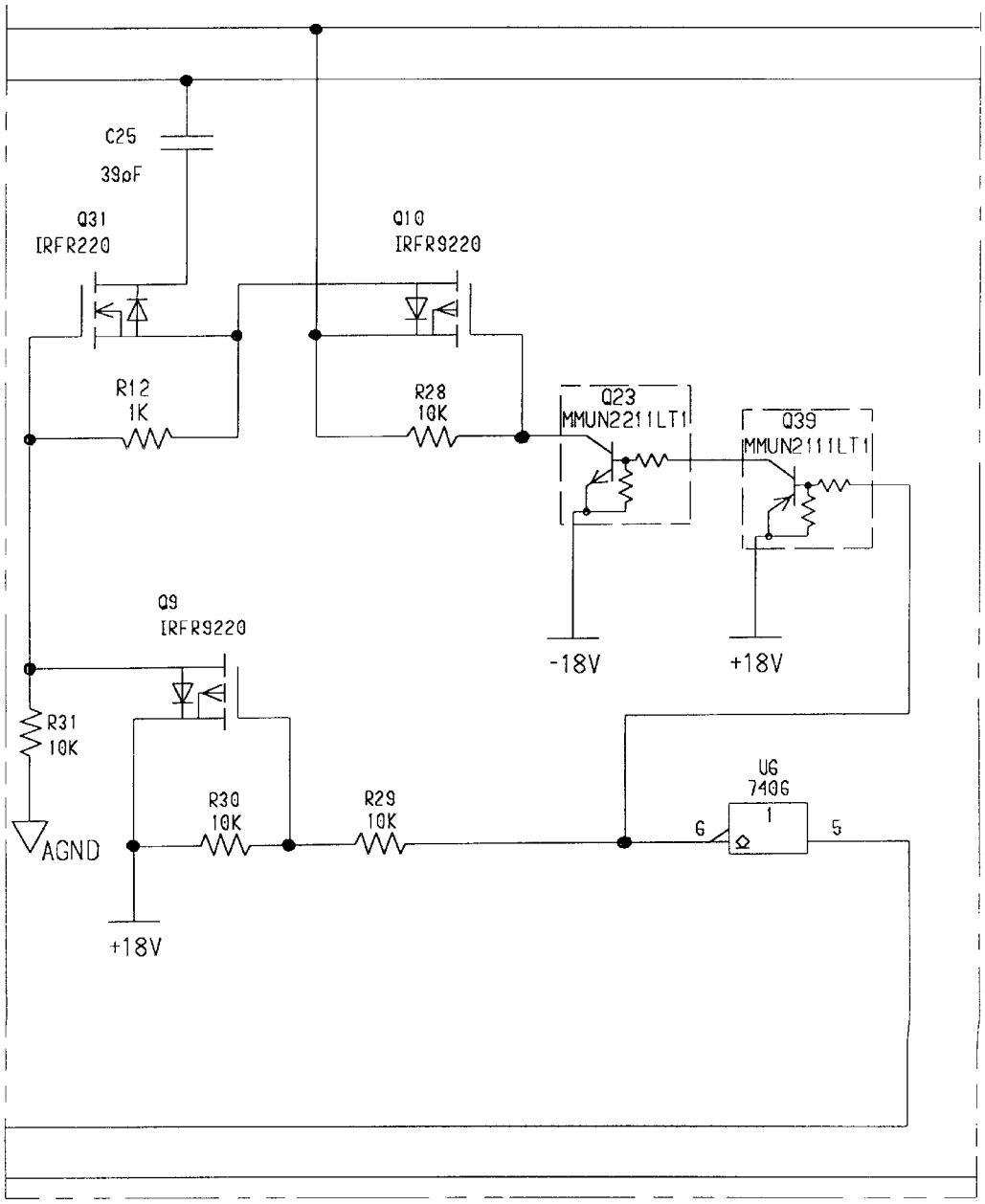
Figure 17D:
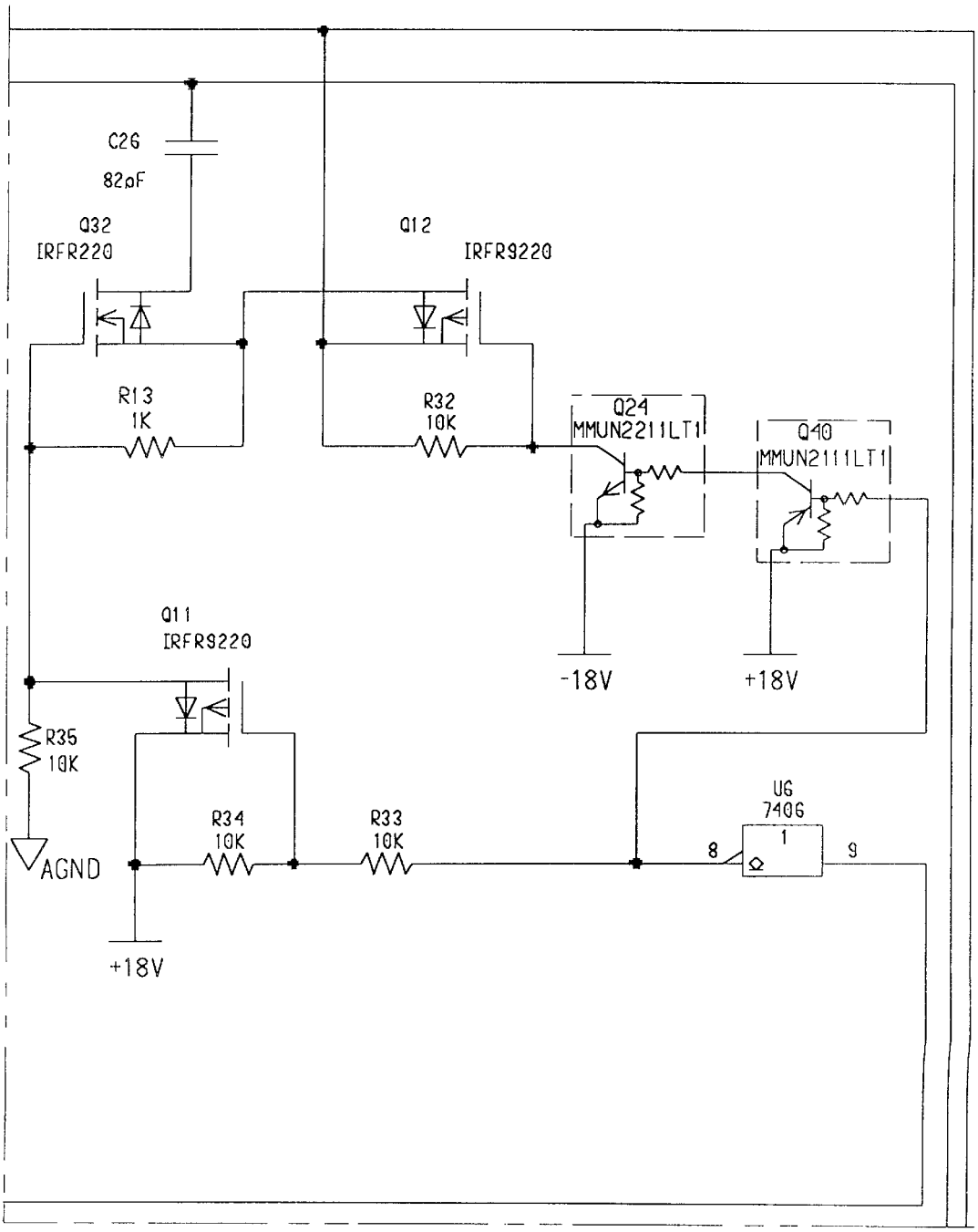
Figure 17E:
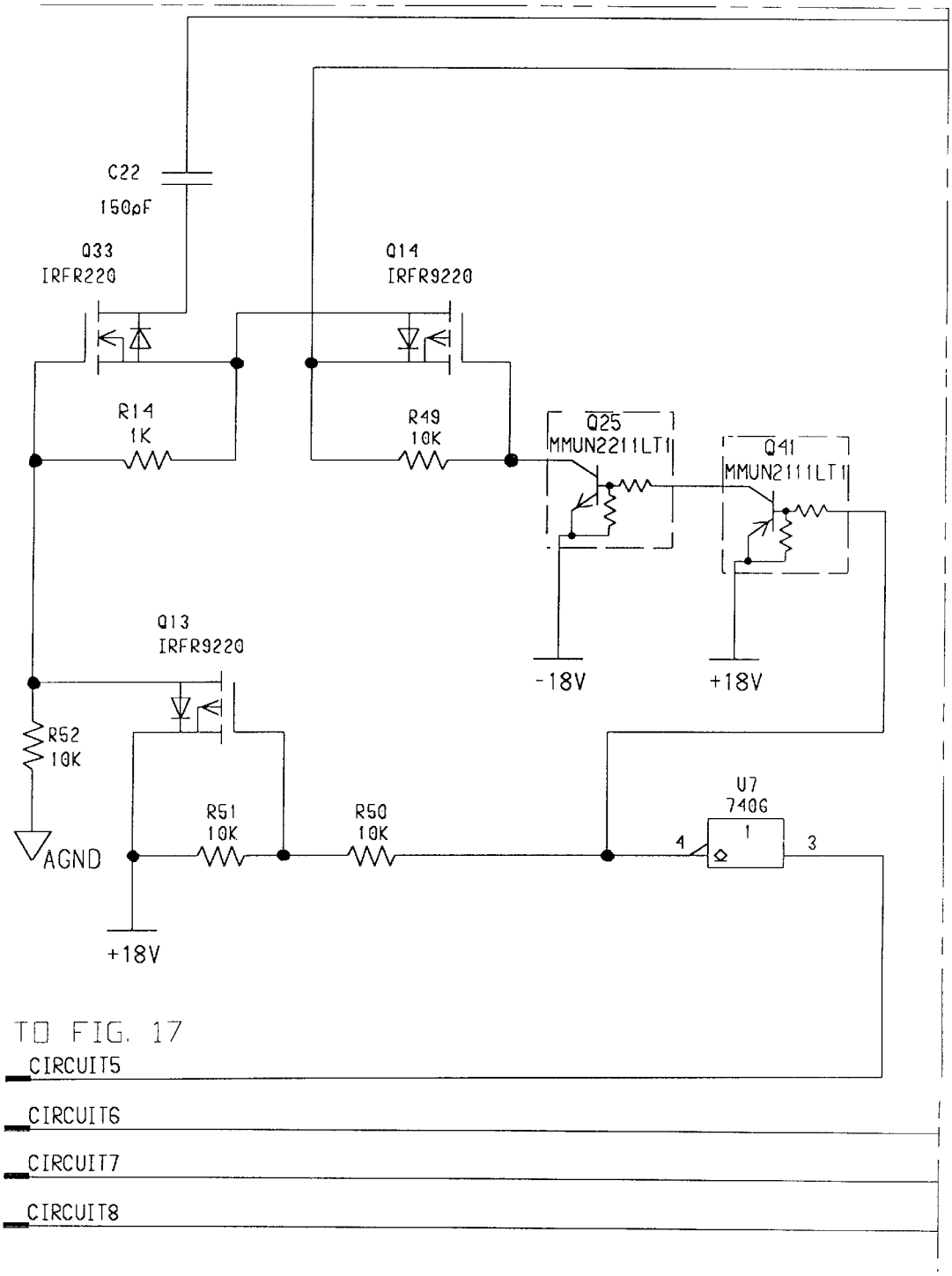
Figure 17F:
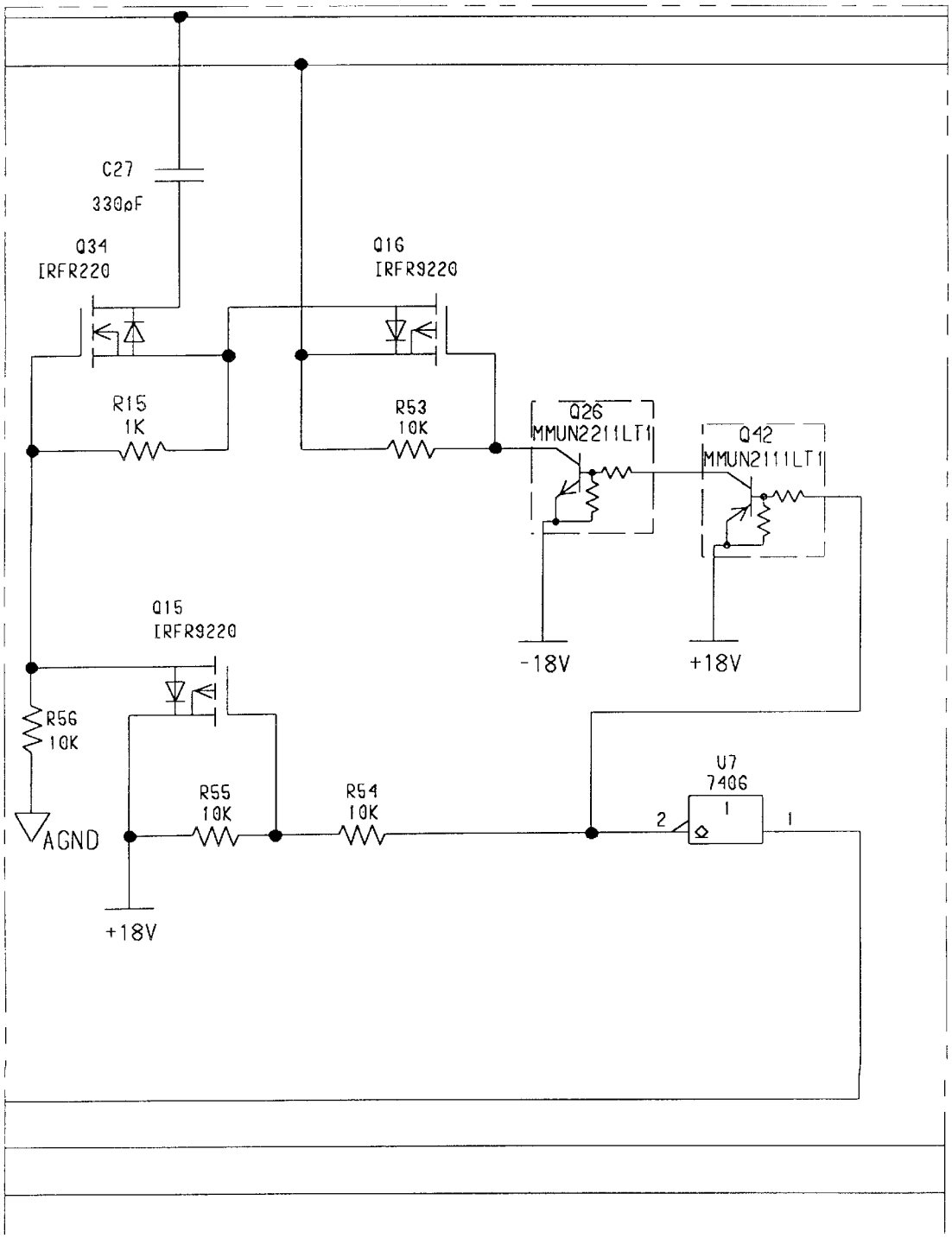
Figure 17G:
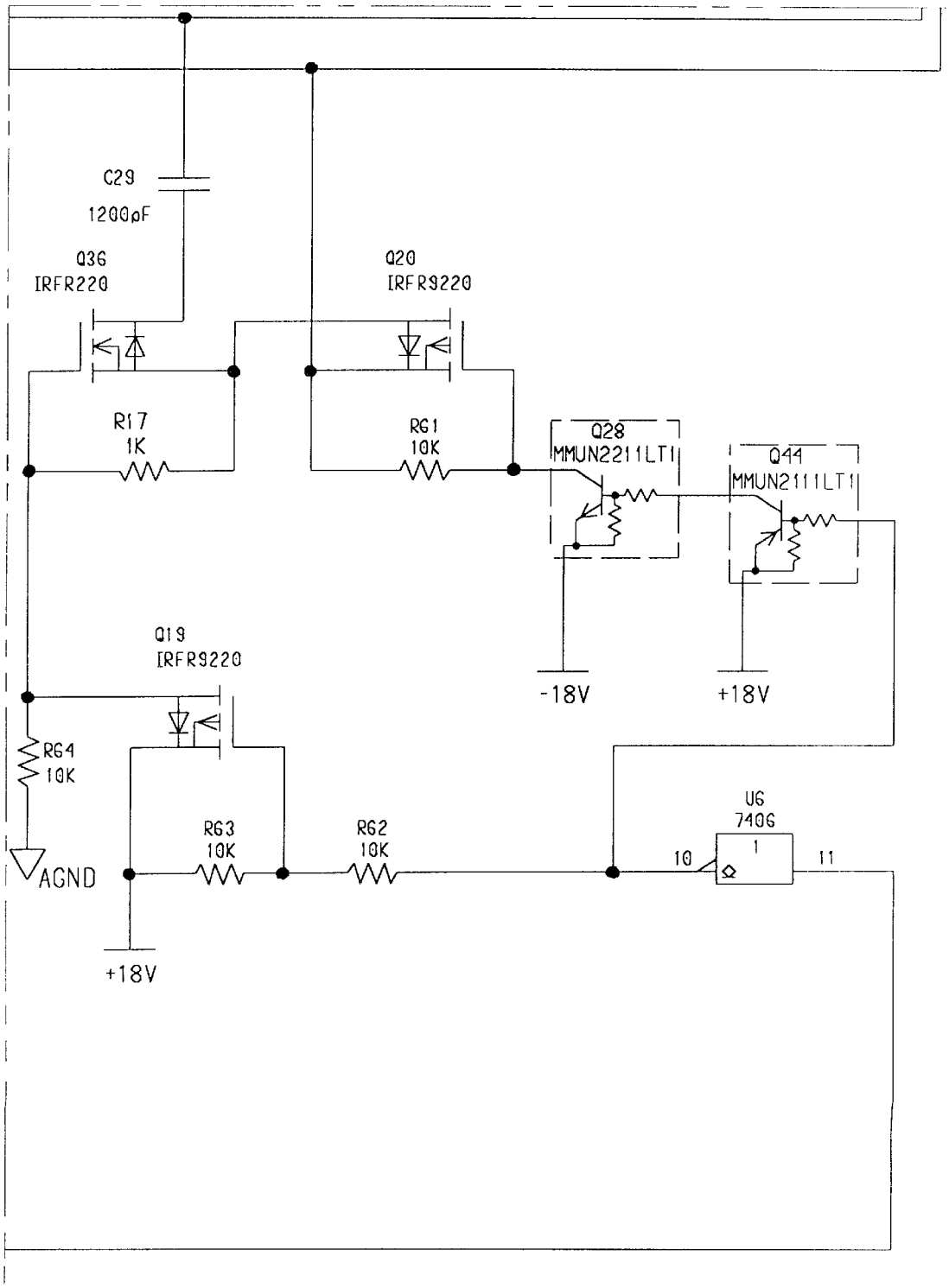
Figure 17H:
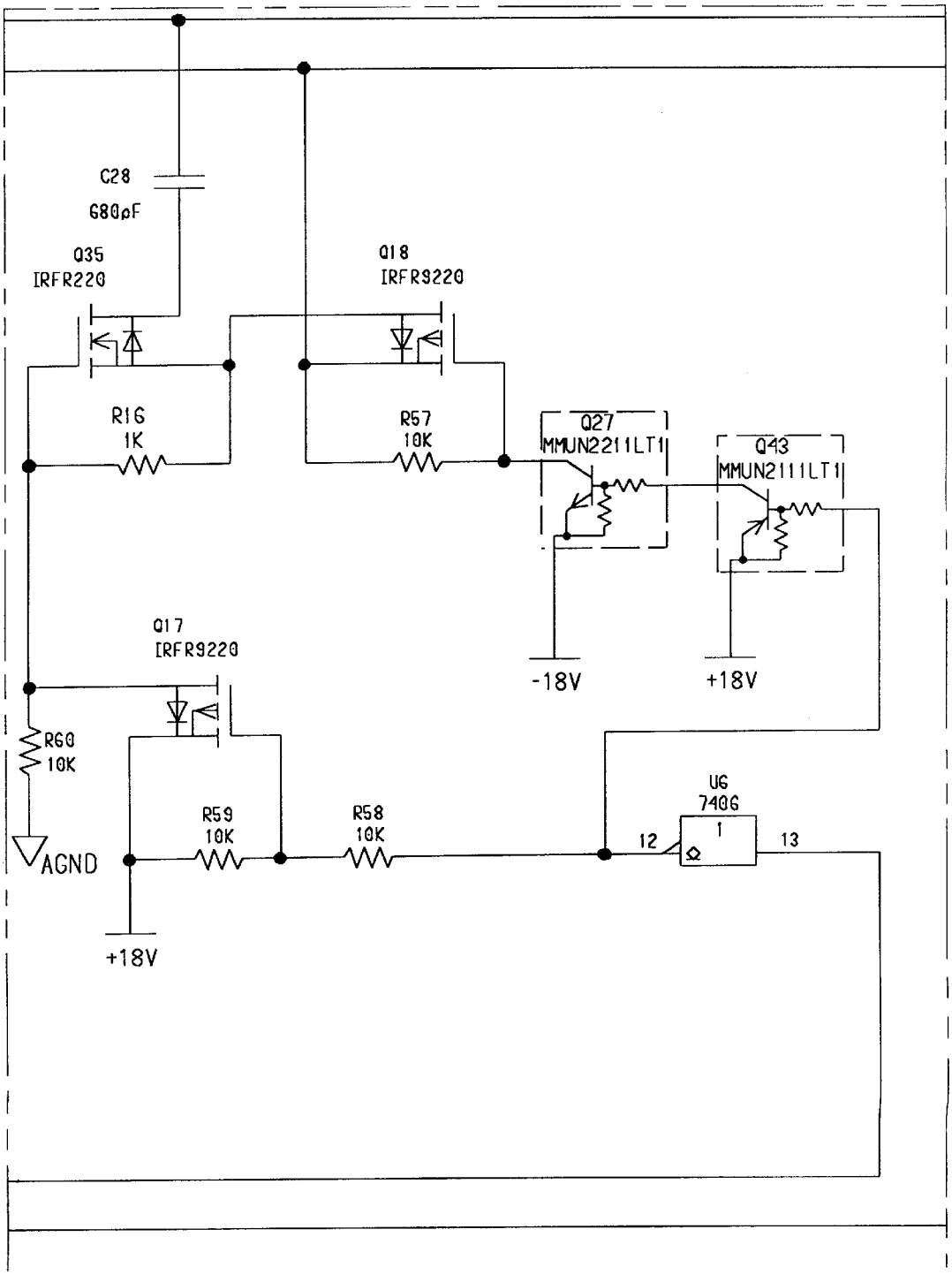

FIG. 15 is a graph of actual data of the voltage difference and the fuze output voltage for different values of capacitor in the fuse. The current difference, fuze voltage, ambient noise voltage and fuze setter current are all plotted. The bandwidth across the abscissa of the plot is the resonant frequency of the fuze circuitry for each value of fuse capacitor.

FIG. 16 is a detailed circuit diagram of the fuze setter circuitry. The current is measured by detecting the voltage across the 1 ohm resistor, shown at 120, between the 2000 pF capacitor, shown at 122 and ground. This voltage is buffered at 124 and then routed to a peak detector section of circuitry shown at 126, after which it is input to microcontroller 84. D-latch 128 is used to switch a bank of capacitors (shown in FIG. 17) used to provide the adaptive tuning.

The above Examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is as follows:

1. An improved transmitter coil for a programmable projectile fuze, comprising:

a coil core formed of a winding which includes a wrapped coil portion and a return coil portion;

the wrapped coil portion wrapping around a section of the circumference of a projectile adjacent a receiver coil contained inside the projectile, the wrapped coil portion having first and second ends, and the return coil portion extending from the first end to the second end, the return coil portion being formed at 90° to the wrapped coil portion, whereby the transmitter coil forms an "L" shaped cross section which eliminates counter magnetic field due to the return coil portion being at right angles to the wrapped coil portion.

2. The improved transmitter coil of claim 1 wherein the first and second ends are approximately 180° apart around the circumference of the projectile.

3. A system for setting a projectile fuze, comprising:

a fuze setter including a controller, the controller being conductively connected to a transmitter and a receiver, the transmitter and receiver each being conductively connected to a first inductive coil, the first inductive coil being part of a resonant LC circuit;

an electronic fuze incorporated into a projectile and including a second inductive coil in an inductively coupled relationship with the first inductive coil, the fuze including circuitry for sending a talkback message back to the controller using the second inductive coil, the talkback message confirming data sent by the transmitter to the electronic fuze using the first inductive coil;

the fuze setter further including circuitry for adaptively tuning the resonant LC circuit for resonance by adjusting the capacitance in the LC circuit to maximize current in the LC circuit.

4. The system for setting a projectile fuze of claim 3 wherein the capacitance in the LC circuit is adjusted using a switched capacitor circuit.

5. The system for setting a projectile fuze of claim 3 wherein the data is transmitted to the electronic fuze by pulse width modulating (PWM) a carrier signal.

6. The system for setting a projectile fuze of claim 3 wherein the electronic fuze generates the talkback message by pulse code modulating (PCM) a carrier signal.

7. The system for setting a projectile fuze of claim 5 wherein the carrier signal has a frequency of 100 MHZ.

8. The system for setting a projectile fuze of claim 6 wherein the electronic fuze pulse code modulates the carrier signal by modulating the impedance of the electronic fuze circuitry to send the talkback message back to the controller, the modulated impedance resulting in changes in the current in the resonant LC circuit of the fuze setter which are detected by a demodulator and input to the controller.

9. The system for setting a projectile fuze of claim 8 wherein the impedance is modulated by switching a transistor on and off in the electronic fuze circuit at predetermined intervals.

10. The system of claim 3 for setting a projectile fuze of a succession of projectiles being fed to a projectile launcher.

11. The system of claim 10 further including a positioning mechanism to move the fuze setter into an inductive relationship with the electronic fuze of a projectile moving toward a projectile launcher.

12. The system of claim 11 wherein the positioning mechanism can move the fuze setter into an inductive relationship with the electronic fuze of projectiles up to 1000 mm.

13. The system of claim 12 wherein the positioning mechanism and fuze setter are capable of handling a rate of fire of 10 projectiles per minute.

14. The system of claim 12 wherein the positioning mechanism can move the fuze setter both vertically and horizontally to position the fuze setter properly for the differently sized projectiles.

15. The system of claim 3 wherein the first inductive coil comprises:

a coil core formed of a winding which includes a wrapped coil portion and a return coil portion;

the wrapped coil portion wrapping around a section of the circumference of the projectile adjacent a receiver coil contained inside the projectile, the wrapped coil portion having first and second ends, and the return coil portion extending from the first end to the second end, the return coil portion being formed at 90° to the wrapped coil portion, whereby the first inductive coil forms an "L" shaped cross section which eliminates counter magnetic field due to the return coil portion being at right angles to the wrapped coil portion.

* * * * *

UNITED STATES PATENT AND TRADEMARK OFFICE

CERTIFICATE OF CORRECTION

PATENT NO. : 6,176,168 B1
DATED : January 23, 2001
INVENTOR(S) : Robert Keil and Randy Humbert It is certified that error appears in the above-identified patent and that said Letters Patent is hereby corrected as shown below:

Column 4,
Line 24, delete "(PWWM)" and insert -- (PWM) --

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*